US010018324B2

(12) United States Patent
Nakagawa et al.

(10) Patent No.: US 10,018,324 B2
(45) Date of Patent: Jul. 10, 2018

(54) LIGHT SOURCE UNIT WITH LIGHT EMITTING MODULE, SEALING PART AND LENS PART

(71) Applicant: KOITO MANUFACTURING CO., LTD., Tokyo (JP)

(72) Inventors: Tomoyuki Nakagawa, Shizuoka (JP); Atsushi Ozawa, Shizuoka (JP); Ryota Naito, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 114 days.

(21) Appl. No.: 15/084,647

(22) Filed: Mar. 30, 2016

(65) Prior Publication Data

US 2016/0290587 A1 Oct. 6, 2016

(30) Foreign Application Priority Data

Mar. 31, 2015 (JP) ..... 2015-072898
Feb. 5, 2016 (JP) ..... 2016-021208

(51) Int. Cl.

| | |
|---|---|
| ***F21S 41/19*** | (2018.01) |
| ***F21S 8/10*** | (2006.01) |
| ***F21S 41/141*** | (2018.01) |
| ***F21S 41/29*** | (2018.01) |
| ***F21S 41/255*** | (2018.01) |
| ***F21S 43/19*** | (2018.01) |
| ***F21S 43/14*** | (2018.01) |
| ***F21S 43/27*** | (2018.01) |
| ***F21S 43/20*** | (2018.01) |
| ***F21S 45/10*** | (2018.01) |
| *F21V 5/04* | (2006.01) |
| *F21Y 115/10* | (2016.01) |
| *F21S 45/47* | (2018.01) |

(52) U.S. Cl.

CPC ..... *F21S 48/2212* (2013.01); *F21S 41/141* (2018.01); *F21S 41/192* (2018.01); *F21S 41/194* (2018.01); *F21S 41/255* (2018.01); *F21S 41/295* (2018.01); *F21S 43/14* (2018.01); *F21S 43/195* (2018.01); *F21S 43/26* (2018.01); *F21S 43/27* (2018.01); *F21S 45/10* (2018.01); *F21S 45/47* (2018.01); *F21V 5/04* (2013.01); *F21Y 2115/10* (2016.08)

(58) Field of Classification Search

CPC ..... F21Y 2115/10
USPC ..... 257/98, 100
See application file for complete search history.

(56) References Cited

U.S. PATENT DOCUMENTS 7,777,247 B2 * 8/2010 Loh ..... H01L 33/486 257/100
7,948,001 B2 * 5/2011 Kamada ..... F21K 9/00 257/100
8,835,969 B2 * 9/2014 Jang ..... H01L 33/486 257/100

(Continued)

FOREIGN PATENT DOCUMENTS

JP 2013-200973 A 10/2013

*Primary Examiner* — Robert May
(74) *Attorney, Agent, or Firm* — Sughrue Mion, PLLC

(57) ABSTRACT

A light source unit of one embodiment includes a socket housing, a light emitting module, a substrate, a sealing part, and a lens part. The sealing part seals the light emitting element and the conductive part to the substrate. A lens part is formed on the sealing part. Alastic modulus of the lens part is higher than that of the sealing part.

9 Claims, 20 Drawing Sheets

(56) References Cited

U.S. PATENT DOCUMENTS

| | | | | |
|---|---|---|---|---|
| 2010/0128489 | A1* | 5/2010 | Holder | F21K 9/00 362/329 |
| 2011/0085334 | A1* | 4/2011 | Wang | F21V 31/04 362/249.02 |
| 2012/0018754 | A1* | 1/2012 | Lowes | F21V 3/0481 257/98 |
| 2012/0218773 | A1* | 8/2012 | Peiler | F21S 48/115 362/520 |

* cited by examiner

LIGHT SOURCE UNIT WITH LIGHT EMITTING MODULE, SEALING PART AND LENS PART

CROSS-REFERENCE TO RELATED APPLICATIONS

This application claims priorities from Japanese Patent Applications No. 2015-072898 filed on Mar. 31, 2015 and No. 2016-021208 filed on Feb. 5, 2016, the entire contents of which are incorporated herein by reference.

FIELD

The present invention relates to a technical field of a light source unit which includes a socket housing and a substrate disposed in the socket housing, a method of manufacturing the light source unit, and a vehicle lamp including the light source unit.

BACKGROUND

For example, there is known a vehicle lamp in which a light source unit is detachably provided in an outer lamp housing constituted by a lamp body and a cover, and a light emitting element such as a light emitting diode is used as a light source of the light source unit.

In such a light source unit, the light emitting element serving as the light source, a wiring pattern for supplying current to at least the light emitting element, and a substrate formed with the wiring pattern are provided, and the substrate is disposed in a socket housing (e.g., JP2013200973A).

In the light source unit as described above, various elements such as a light emitting element are mounted on the substrate. Therefore, it is required to secure a stable driving state of each part by securing a good mounting state of each part such as the light emitting element on the substrate.

Further, it is necessary to direct the light emitted from the light emitting element mounted on the substrate toward a required direction and it is also necessary to increase the emission efficiency of light which is emitted from the light emitting element and is directed to the outside.

SUMMARY

Therefore, a light source unit of the present invention aims to solve the above-described problems, to secure a good mounting state of the light emitting element mounted on the substrate and to secure a good emission state of light which is emitted from the light emitting element and directed to the outside.

In the first, a light source unit according to the present invention includes: a socket housing which has an engaging portion to be engaged with a predetermined member; a light emitting module which is disposed in the socket housing and has a light emitting element serving as a light source, a substrate formed with a wiring pattern for supplying current to at least the light emitting element and a conductive part for connecting the light emitting element to the wiring pattern; a sealing part for sealing the light emitting element and the conductive part to the substrate; and a lens part formed on the sealing part. Further, elastic modulus of the lens part is higher than that of the sealing part.

In this way, the light emitting element and the conductive part are sealed by the sealing part and are covered by the lens part having high molding accuracy.

In the second, in the light source unit according to the present invention, it is preferable that a plurality of light emitting elements is provided, each light emitting element includes a first light emitting element and a second light emitting element, and the first light emitting element and the second light emitting element are separately sealed by the sealing part.

In this way, the shape, size and type of the lens part can be changed in accordance with the function of the light emitting element.

In the third, another light source unit according to the present invention includes: a socket housing which has an engaging portion to be engaged with a predetermined member; a light emitting module which is disposed in the socket housing and has a light emitting element serving as a light source, a substrate formed with a wiring pattern for supplying current to at least the light emitting element and a conductive part for connecting the light emitting element to the wiring pattern; a sealing part for sealing the light emitting element and the conductive part to the substrate; and a lens part which has a cover lens portion for covering at least a portion of the sealing part and a leg portion protruding from the cover lens portion and positioned in contact with the substrate.

In this way, the light emitting element and the conductive part are sealed by the sealing part and are covered by the lens part having high molding accuracy.

In the fourth, in another light source unit according to the present invention, it is preferable that the lens part is formed with an opening portion of the leg portion, the lens part is disposed on the substrate by pressing the cover lens portion against the sealing part before a curing of the sealing part.

In this way, the cover lens portion is pressed against the sealing part, and hence, a portion of the sealing part is extruded from the opening portion. As a result, unnecessary voids are less likely to occur between the cover lens portion and the sealing part.

In the fifth, in another light source unit according to the present invention, it is preferable that a boundary portion between the cover lens portion and an inner surface of the leg portion is formed as a curved surface portion.

In this way, unnecessary voids are less likely to occur in the boundary portion between the cover lens portion and the inner surface of the leg portion.

In the sixth, in another light source unit according to the present invention, it is preferable that the cover lens portion is formed with a pressing surface which is pressed against the sealing part and is convex toward the sealing part.

In this way, the sealing part is extruded by the pressing surface, and hence, unnecessary voids are less likely to occur between the pressing surface and the sealing part.

In the seventh, in another light source unit according to the present invention, it is preferable that a plurality of light emitting elements is provided and each light emitting element includes a first light emitting element and a second light emitting element, which are separately sealed by the sealing part.

In this way, the shape, size and type of the lens part can be changed in accordance with the function of the light emitting element.

In the eighth, another light source unit according to the present invention includes: a socket housing which has an engaging portion to be engaged with a predetermined member; a light emitting module which is disposed in the socket housing and has a light emitting element serving as a light source, a substrate formed with a wiring pattern for supplying current to at least the light emitting element and a conductive part for connecting the light emitting element to the wiring pattern; a frame body which is attached to the substrate and surrounds the light emitting element and the conductive part; a sealing part for sealing the light emitting element and the conductive part to the substrate at an inside of the frame body; and a lens part formed on the sealing part.

In this way, the light emitting element and the conductive part are sealed by the sealing part and are covered by the lens part having high molding accuracy.

In the ninth, in another light source unit according to the present invention, it is preferable that the frame body is provided as a reflector for reflecting a portion of the light emitted from the light emitting element.

In this way, the frame body has both a function of determining the shape of the sealing part and a function of reflecting light.

In the tenth, in another light source unit according to the present invention, it is preferable that the frame body is formed by a solidification of flowable resin applied on the substrate, a control element for driving the light emitting element is mounted on an outside of the frame body on the substrate, and, in a flowable resin application process for forming the frame body, a portion of the flowable resin is applied on the control element.

In this way, the flowable resin is applied on the control element in an operation of forming the frame body.

In the eleventh, in another light source unit according to the present invention, it is preferable that the frame body is formed by a multi-stage application of the flowable resin.

In this way, it is possible to increase the height of the frame body.

In the twelfth, in another light source unit according to the present invention, it is preferable that the sealing part is applied on the substrate at an inside of the frame body; a molding resin is applied on the sealing part; and the lens part is formed by curing the molding resin.

In this way, the light emitting element and the conductive part are sealed by the sealing part and are covered by the lens part having high molding accuracy.

In the thirteenth, a vehicle lamp according to the present invention includes a light source unit. The light source unit includes a socket housing which has an engaging portion to be engaged with a predetermined member; a light emitting module which is disposed in the socket housing and has a light emitting element serving as a light source, a substrate formed with a wiring pattern for supplying current to at least the light emitting element and a conductive part for connecting the light emitting element to the wiring pattern; a sealing part for sealing the light emitting element and the conductive part to the substrate; and a lens part formed on the sealing part. Further, elastic modulus of the lens part is higher than that of the sealing part.

In this way, the light source unit is configured such that the light emitting element and the conductive part are sealed by the sealing part and are covered by the lens part having high molding accuracy.

In the fourteenth, another vehicle lamp according to the present invention includes a light source unit. The light source unit includes a socket housing which has an engaging portion to be engaged with a predetermined member; a light emitting module which is disposed in the socket housing and has a light emitting element serving as a light source, a substrate formed with a wiring pattern for supplying current to at least the light emitting element and a conductive part for connecting the light emitting element to the wiring pattern; a sealing part for sealing the light emitting element and the conductive part to the substrate; and a lens part which has a cover lens portion for covering at least a portion of the sealing part and a leg portion protruding from the cover lens portion and positioned in contact with the substrate.

In this way, the light source unit is configured such that the light emitting element and the conductive part are sealed by the sealing part and are covered by the lens part having high molding accuracy.

In the fifteenth, another vehicle lamp according to the present invention includes a light source unit. The light source unit includes a socket housing which has an engaging portion to be engaged with a predetermined member; a light emitting module which is disposed in the socket housing and has a light emitting element serving as a light source, a substrate formed with a wiring pattern for supplying current to at least the light emitting element and a conductive part for connecting the light emitting element to the wiring pattern; a frame body which is attached to the substrate and surrounds the light emitting element and the conductive part; a sealing part is applied on the substrate at the inside of the frame body to seal the light emitting element and the conductive part; and a lens part formed on the sealing part.

In this way, the light source unit is configured such that the light emitting element and the conductive part are sealed by the sealing part and are covered by the lens part having high molding accuracy.

According to the present invention, the light emitting element and the conductive part are sealed by the sealing part and the light emitting element is covered by the lens part having high molding accuracy. Therefore, it is possible to secure a good bonding state of the light emitting element mounted on the substrate and to secure a good emission state of light which is emitted from the light emitting element and directed to the outside.

DETAILED DESCRIPTION

Hereinafter, an embodiment for carrying out the present invention will be described with reference to the accompanying drawings.

In the illustrative embodiments described below, a light source unit of the present invention is applied to a light source unit used in a combination lamp having a function of a stop lamp and a tail lamp, a method of manufacturing a light source unit of the present invention is applied to a method of manufacturing this light source unit, and a vehicle lamp of the present invention is applied to a vehicle lamp including this light source unit. However, it should be noted that the scope of the present invention is not limited to the light source unit used in the combination lamp having the function of the stop lamp and the tail lamp, a light source unit manufacturing method, and the vehicle lamp including the light source unit.

A light source unit of the present invention can be widely applied to a light source unit which is used in various vehicle lamps such as a headlamp, a clearance lamp, a tail lamp, a turn signal lamp, a stop lamp, a daytime running lamp, a cornering lamp, a hazard lamp, a position lamp, a back lamp, a fog lamp, or a combination lamp thereof. Further, the method of manufacturing the light source unit of the present invention can be widely applied to a manufacturing method for these various light source units, and the vehicle lamp of the present invention can be widely applied to a vehicle lamp including these various light source units.

In the following description, a front-rear direction, an up-down direction and a left-right direction are defined in such a manner that an optical axis direction is set as the front-rear direction, and an emission direction of light is set as a rear side. Meanwhile, the front-rear direction, the up-down direction and the left-right direction, which are described below, are defined for convenience of explanation. The practice of the present invention is not limited to these directions.

Figure 1:
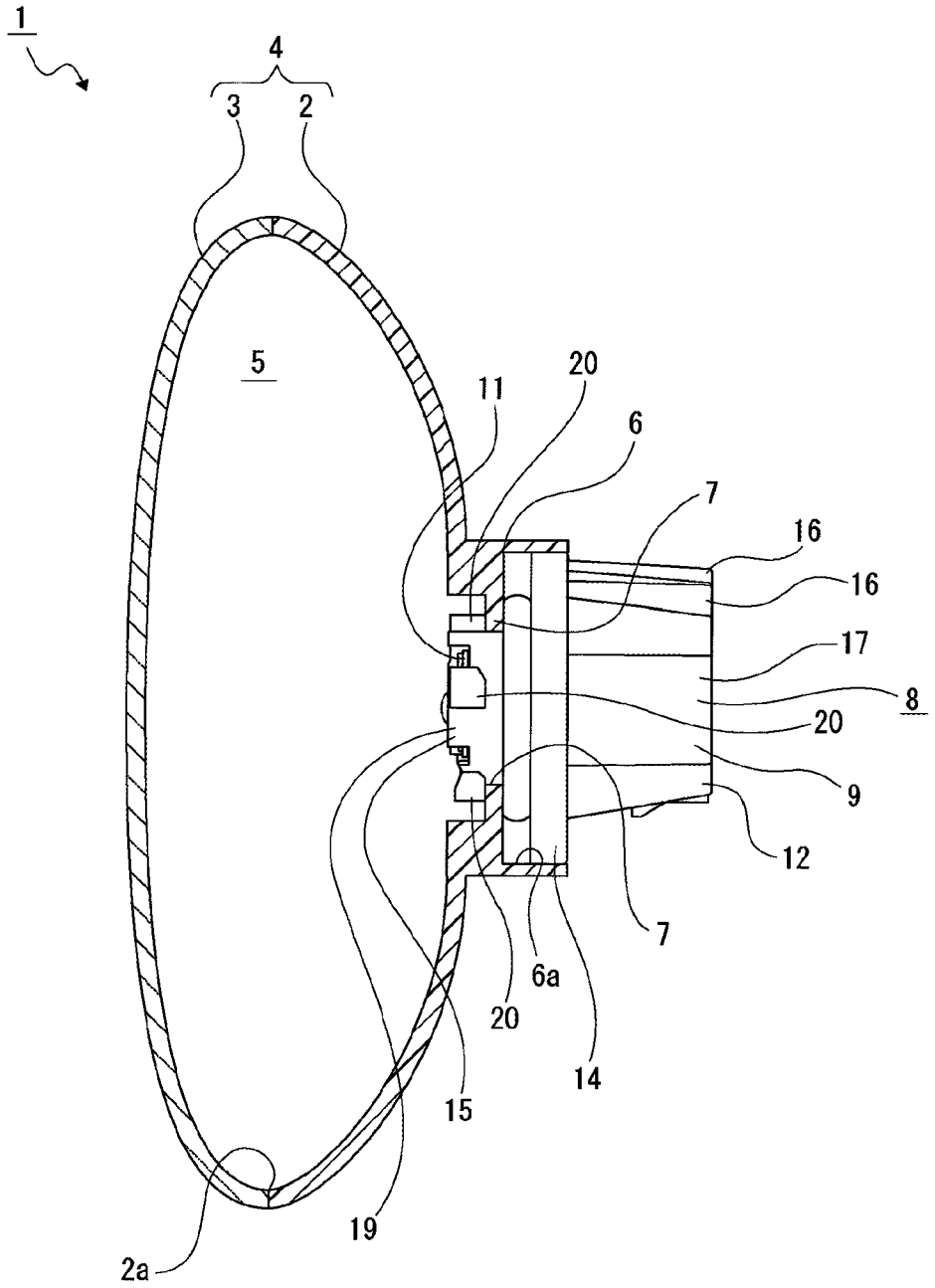
FIG. 1 is a sectional view of a vehicle lamp, showing an illustrative embodiment of the present invention, together with FIGS. 2 to 35.

First, a schematic configuration of a vehicle lamp is described (see FIG. 1).

A vehicle lamp 1 is respectively attached and arranged at both left and right ends of the front end portion of a vehicle body.

The vehicle lamp 1 includes a lamp body 2 having a recess opened rearward and a cover 3 closing a rear opening 2*a* of the lamp body 2. An outer lamp housing 4 is configured by the lamp body 2 and the cover 3. An inner space of the outer lamp housing 4 is formed as a lamp chamber 5.

A front end portion of the lamp body 2 is provided as a substantially cylindrical unit mounting portion 6 that penetrates in the front-rear direction. An internal space of the unit mounting portion 6 is formed as a mounting hole 6*a*. At an inner peripheral surface of the unit mounting portion 6, engaging protrusions 7, 7, . . . protruding inwardly are provided so as to be spaced apart from each other in a circumferential direction.

Subsequently, a structure of a light source unit 8, which is attached to the lamp body 2, is described (see FIGS. 2 to 6).

The light source unit 8 is removably attached to the unit mounting portion 6 of the lamp body 2. The light source unit 8 includes a socket housing 9, a power feeder 10 and a light emitting module 11 (see FIGS. 2 to 6).

The socket housing 9 is formed by an integral molding of a resin molding part 12 and a heat-dissipation plate 13. As the integral molding, for example, a so-called insert molding is used in which a molten resin (resin material) is filled in a state where a metallic material is retained in a cavity of a mold and a molded product is integrally formed by the metallic material and the resin material.

The resin molding part 12 has an excellent thermal conductivity and is formed of, for example, a resin material which contains carbon or the like. The resin molding part 12 also has conductivity. It is preferable that thermal conductivity of the resin molding part 12 is in a range of 1 W/mk to 30 W/mk. Additionally, it is preferable that thermal conductivity of the resin molding part 12 is lower than that of the heat-dissipation plate 13 and higher than that of a terminal holding part 21 (to be described later). The resin molding part 12 has a disc-shaped base surface portion 14 facing the front-rear direction, a protrusion-shaped portion 15 protruding rearward from the center of the base surface portion 14, first heat-dissipation fins 16, 16, . . . protruding forward from the base surface portion 14, second heat-dissipation fins 17, 17 protruding forward from the base surface portion 14, and a connector connection portion 18 protruding forward from the base surface portion 14.

The protrusion-shaped portion 15 includes a substrate placement portion 19 having a circular outer shape and engaging portions 20, 20, . . . provided at an outer peripheral surface of the substrate placement portion 19.

The substrate placement portion 19 is formed with a placement recess 19*a* opened rearward. The placement recess 19*a* has a substantially rectangular shape and is slightly greater than an outer shape of the light emitting module 11. The engaging portions 20, 20, . . . are provided so as to be spaced apart from each other in the circumferential direction. The engaging portions 20, 20, . . . are located at a rear end portion of the substrate placement portion 19.

Figure 6:
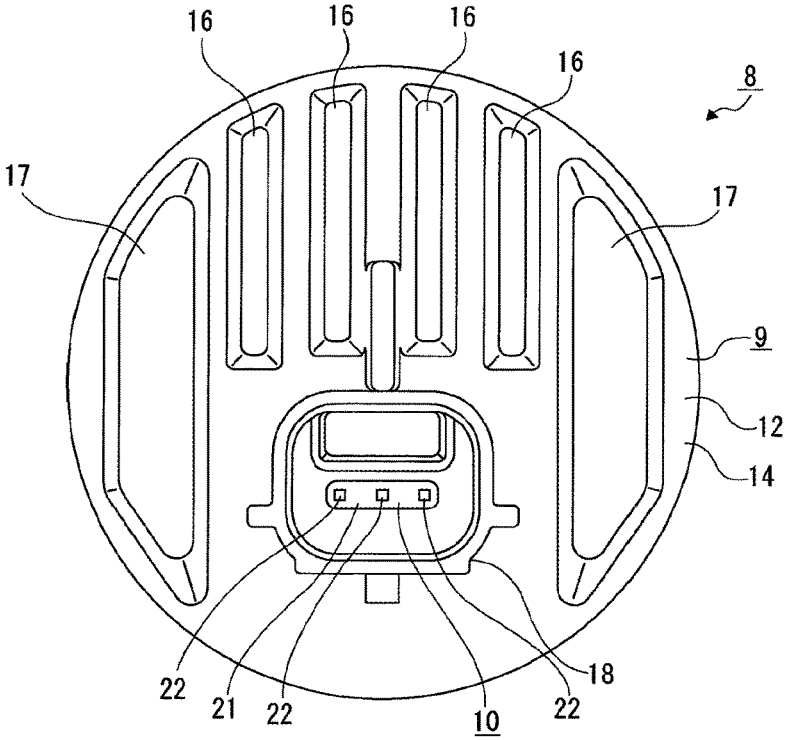
FIG. 6 is a rear view of the light source unit.

The first heat-dissipation fins 16, 16, . . . are provided side by side at equal intervals in the left-right direction, for example, and protrude from an upper half in the portion other than both left and right ends of the base surface portion 14 (see FIG. 6).

The second heat-dissipation fins 17, 17 are respectively disposed at both sides of the first heat-dissipation fins 16, 16, . . . in the left-right direction and protrude from both left and right ends of the base surface portion 14. A thickness in the left-right direction of the second heat-dissipation fins 17, 17 is thicker than a thickness in the left-right direction of the first heat-dissipation fins 16, 16, . . . .

The connector connection portion 18 has a cylindrical shape whose axial direction is the front-rear direction, and is disposed below the first heat-dissipation fin 16, 16, . . . .

Figure 2:
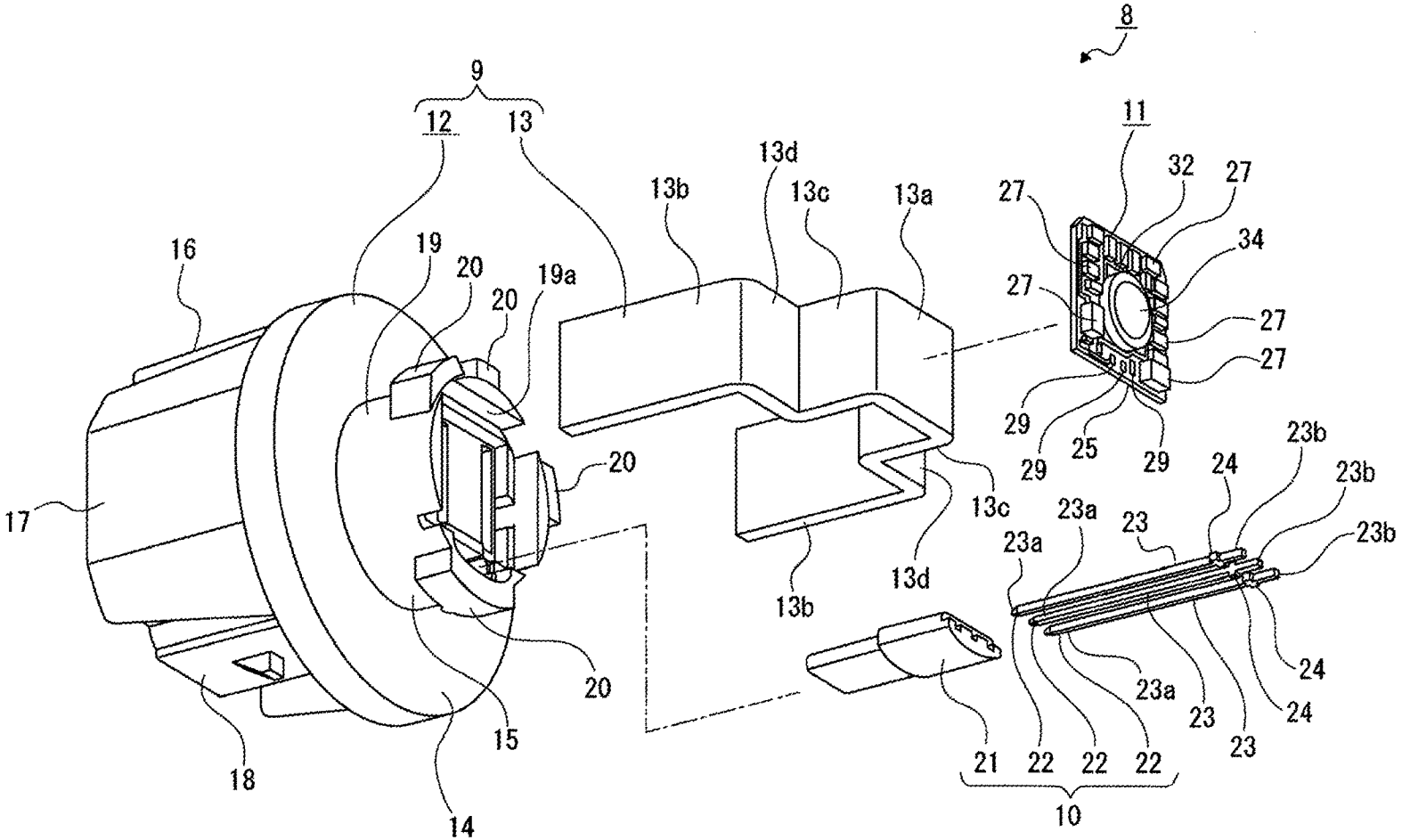
FIG. 2 is an exploded perspective view of a light source unit.
Figure 4:
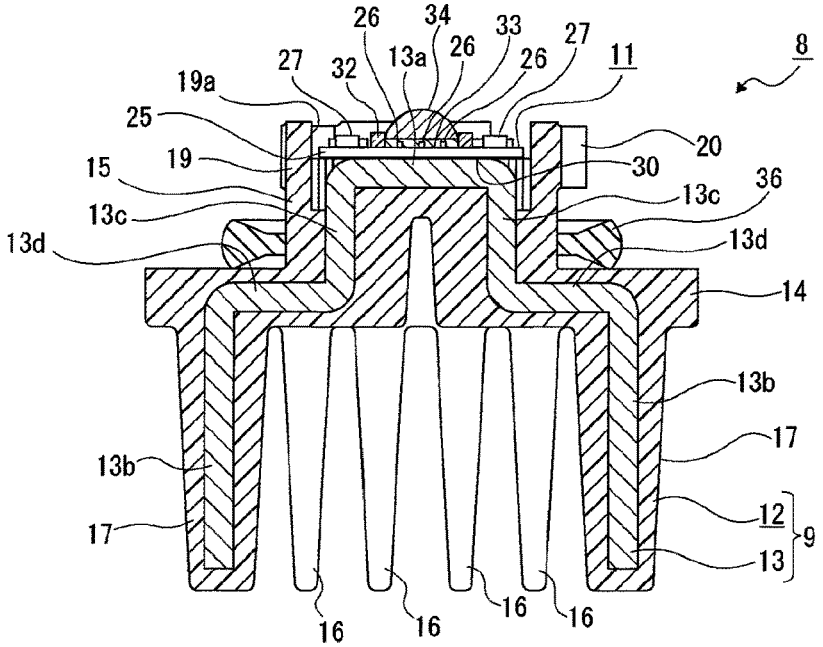
FIG. 4 is a sectional view of the light source unit.
Figure 5:
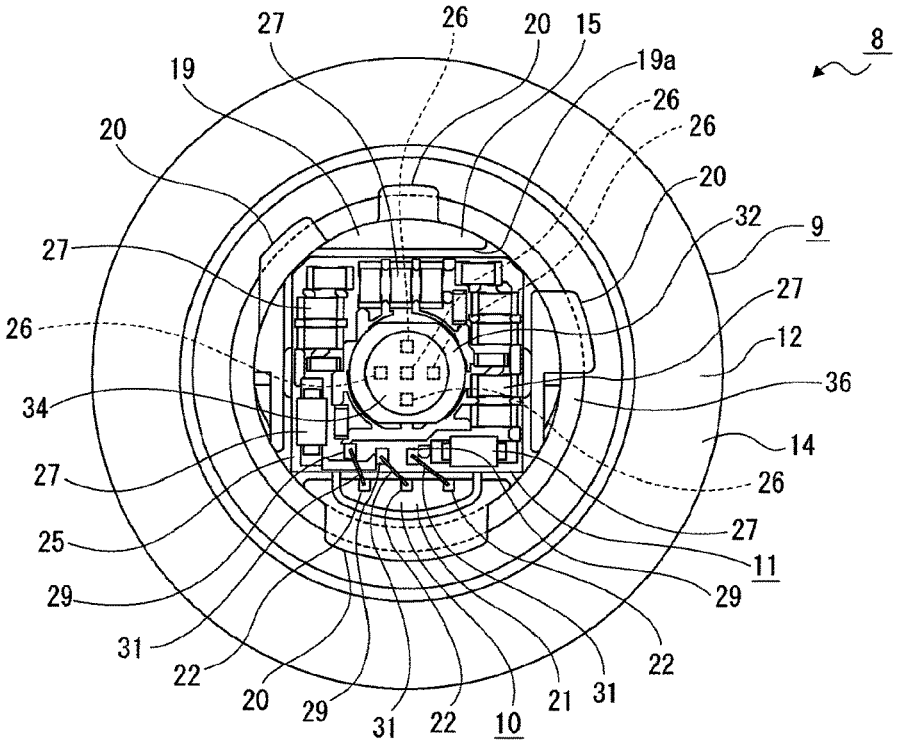
FIG. 5 is a front view of the light source unit.

The heat-dissipation plate 13 is formed in a predetermined shape by a plate-like metallic material such as aluminum having high thermal conductivity (see FIGS. 2 and 4). The heat-dissipation plate 13 includes a first heat-dissipation portion 13*a*, second heat-dissipation portions 13*b*, 13*b*, third heat-dissipation portions 13*c*, 13*c*, and fourth heat-dissipation portions 13*d*, 13*d*.

The first heat-dissipation portion 13*a* and the fourth heat-dissipation portions 13*d*, 13*d* are respectively formed in a substantially rectangular shape facing the front-rear direction. The second heat-dissipation portions 13*b*, 13*b* and the third heat-dissipation portions 13*c*, 13*c* are respectively formed in a substantially rectangular shape facing the left-right direction. Rear ends of the third heat-dissipation portions 13*c*, 13*c* are respectively continuous with both left and right ends of the first heat-dissipation portion 13*a*. Inner ends of the fourth heat-dissipation portions 13*d*, 13*d* are respectively continuous with front ends of the third heat-dissipation portions 13*c*, 13*c* and outer ends thereof are respectively continuous with rear ends of the second heat-dissipation portions 13*b*, 13*b*. Therefore, the third heat-dissipation portions 13*c*, 13*c* are respectively formed by being bent in a direction perpendicular to the first heat-dissipation portion 13*a*. The fourth heat-dissipation portions 13*d*, 13*d* are respectively formed by being bent in a direction perpendicular to the third heat-dissipation portions 13*c*, 13*c*. The second heat-dissipation portions 13*b*, 13*b* are respectively formed by being bent in a direction perpendicular to the fourth heat-dissipation portions 13*d*, 13*d*.

The heat-dissipation plate 13 is configured such that the first heat-dissipation portion 13*a* is disposed in the placement recess 19*a* of the substrate placement portion 19 of the resin molding part 12 and is exposed to the resin molding part 12 (see FIG. 4). The heat-dissipation plate 13 is configured such that the second heat-dissipation portions 13*b*, 13*b* are respectively disposed on the inside of the second heat-dissipation fins 17, 17, the third heat-dissipation portions 13*c*, 13*c* are disposed on the inside of the substrate placement portion 19, and the fourth heat-dissipation portions 13*d*, 13*d* are disposed on the inside of the base surface portion 14.

An insertion and placement hole (not shown) is formed at a position up to the base surface portion 14 from the substrate placement portion 19 of the resin molding part 12. The insertion and placement hole is communicated with the interior of the placement recess 19*a* and the connector coupling portion 18.

The power feeder 10 includes a terminal holding part 21 formed of an insulating resin material and connection terminals 22, 22, 22 (see FIG. 2). The connection terminals 22, 22, 22 are held in the terminal holding part 21 and connected to a power supply circuit (external power; not shown).

The terminal holding part 21 has a flat shape which extends in the front-rear direction and has a thin thickness in the up-down direction.

The connection terminals 22, 22, 22 are formed of a metallic material and disposed side by side in the left-right direction in the interior of the terminal holding part 21 except for a part thereof. Each connection terminal 22 has a terminal portion 23 extending in the front-rear direction and retaining protrusions 24, 24 protruding in opposite directions from a rear end position of the terminal portion 23. A front end portion of the terminal portion 23 is provided as a connector connection portion 23 a and a rear end portion thereof is provided as a wire connection portion 23*b*. At least a portion of the surface of the wire connection portion 23*b* is subjected to surface treatment by nickel or gold or the like, for example.

The connection terminal 22 is configured such that the connector connection portion 23*a* protrudes forward from the terminal holding part 21 and the wire connection portion 23*b* protrudes rearward from the terminal holding part 21. Since the retaining protrusions 24, 24 are positioned at the inside of the terminal holding part 21, the connection terminal 22 is prevented from being detached from the terminal holding part 21 in the front-rear direction.

The power feeder 10 is integrally formed by an insert molding of the terminal holding part 21 and the connection terminals 22, 22, 22, for example. The power feeder 10 is configured such that the portion other than the connector connection portions 23*a*, 23*a*, 23*a* and the wire connection portions 23*b*, 23*b*, 23*b* is inserted into the insertion and placement hole formed in the resin molding part 12, the connector connection portions 23*a*, 23*a*, 23*a* are disposed at the inside of the connector connection portion 18 (see FIG. 6), and the wire connection portions 23*b*, 23*b*, 23*b* are disposed in the placement recess 19*a* (see FIG. 3).

For example, in the state of being formed by an insert molding, the power feeder 10 is positioned in a cavity of a mold, molten resin for forming the resin molding part 12 is filled into the cavity, and the power feeder 10 is formed integrally with the socket housing 9 by an insert molding, for example.

The light emitting module 11 includes a substrate 25 having a substantially rectangular shape facing the front-rear direction, light emitting elements 26, 26, . . . mounted on the substrate 25, and various control elements 27, 27, . . . mounted on the substrate 25 (see FIGS. 2 to 5).

The substrate 25 is, for example, a ceramic substrate. A wiring pattern for supplying current to the light emitting elements 26, 26, . . . is formed in the substrate 25. The size of the substrate 25 is substantially the same as that of the first heat-dissipation portion 13*a* of the heat-dissipation plate 13.

Figure 7:
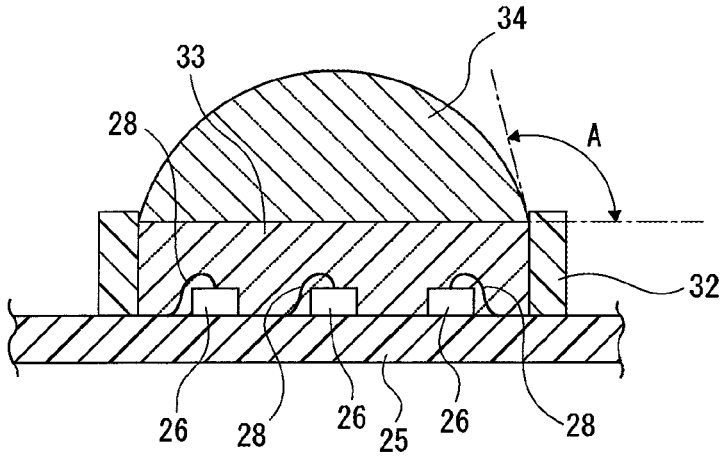
FIG. 7 is a schematic enlarged sectional view showing a state where a lens part is disposed on a sealing part in which a light emitting element is sealed.

For example, five light emitting elements 26, 26, . . . are mounted on the center of the substrate 25. Light emitting diodes (LEDs) are used as the light emitting elements 26, 26, The light emitting elements 26, 26, . . . are configured such that four light emitting elements 26, 26, . . . are mounted around one light emitting element 26 in the state of being spaced apart from each other at equal intervals in the circumferential direction. The center light emitting element 26 serves as a light source for a tail lamp, for example, and four surrounding light emitting elements 26, 26, . . . serve as a light source for a stop lamp, for example. The light emitting elements 26, 26, . . . are respectively connected to the wiring patterns by conductive wires 28, 28, . . . serving as a conductive part (see FIG. 7). Meanwhile, the connection between the light emitting elements 26, 26, . . . and the wiring patterns may be performed by other conductive parts other than the conductive wires 28, 28, . . . , or, may be performed by a flip-chip solder mounting or the like where a solder is used as a conductive part, for example.

The connection terminals 22, 22, 22 are provided as a power supply terminal for a tail lamp, a power supply terminal for a stop lamp and a power supply terminal for an earth, respectively.

Meanwhile, the number and function of the light emitting element 26 mounted on the substrate 25 can be arbitrarily set, depending on the type and the required brightness or the like of the vehicle lamp 1.

For example, diodes, capacitors or resistors or the like are used as the control elements 27, 27, . . . . The control elements 27, 27, . . . are mounted at positions of the light emitting module 11 on the outside of the light emitting elements 26, 26, . . . and are connected to the wiring patterns, respectively.

A rear surface of the substrate 25 is bonded to the surface of the first heat-dissipation portion 13*a* of the heat-dissipation plate 13 by an adhesive 30 (see FIG. 4). A thermally conductive adhesive is used as the adhesive 30.

Figure 3:
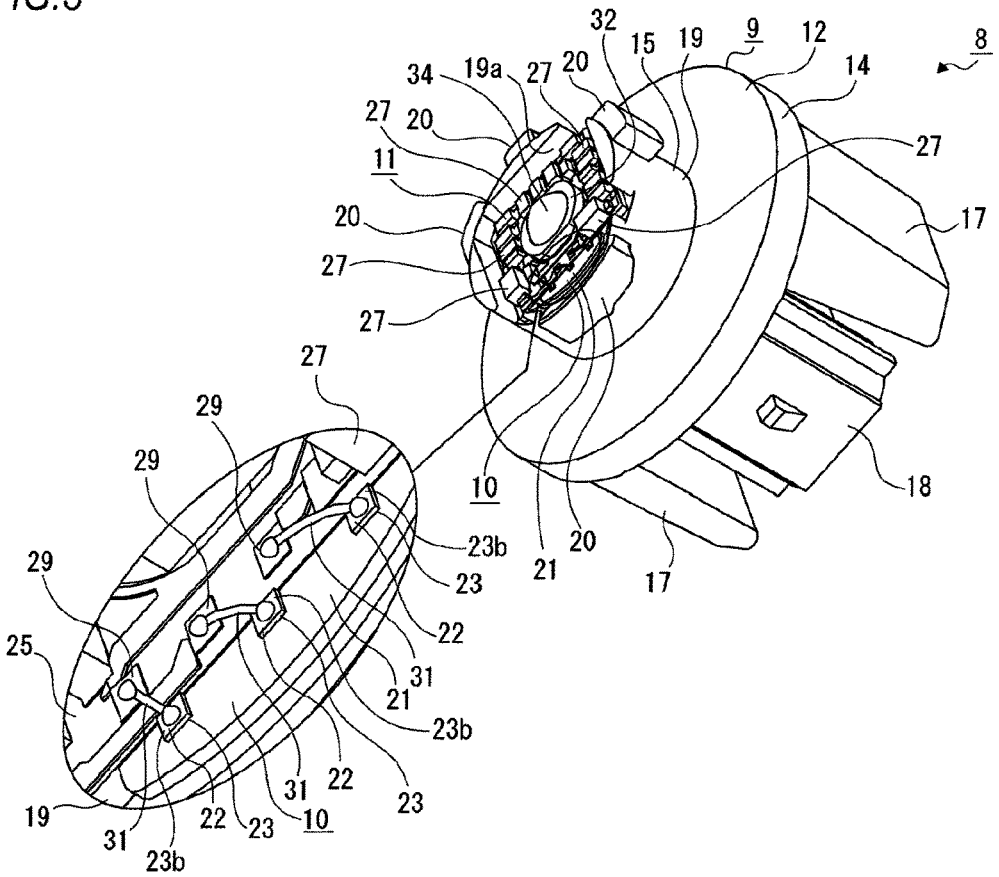
FIG. 3 is a perspective view of the light source unit.

At a lower end portion of the substrate 25, electrode pads 29, 29, 29 are formed side by side in the left-right direction and connected to the wiring patterns (see FIG. 3).

The electrode pads 29, 29, 29 are located in the vicinity of the wire connection portions 23*b*, 23*b*, 23*b* of the connection terminals 22, 22, 22, respectively.

For example, the electrode pads 29, 29, 29 are respectively connected, through ultrasonic welding or soldering or the like, to the wire connection portions 23*b*, 23*b*, 23*b* of the connection terminals 22, 22, 22 by wires 31, 31, 31 formed of aluminum or the like and serving as a conductive connection portion. The connection between the wire connection portion 23*b* and the wire 31 is performed at the portion of the wire connection portion 23*b*, which is subjected to the surface treatment by nickel or gold or the like. In addition, the connection between the electrode pads 29, 29, 29 and the connection terminals 22, 22, 22 may be performed by other conductive connection portions other than the wires 31, 31, 31.

A frame body 32 is attached to the portion of the substrate 25 between the light emitting elements 26, 26, . . . and the control elements 27, 27, . . . (see FIGS. 3, 4 and 7). The frame body 32 is formed in a substantially annular shape by a resin material. The frame body 32 is disposed at a position to surround the light emitting elements 26, 26, . . . and the conductive wires 28, 28, . . . .

A sealing part 33 is applied to the inside of the frame body 32. The light emitting elements 26, 26, . . . and the conductive wires 28, 28, . . . are sealed by the sealing part 33 (see FIG. 7). The sealing part 33 is molded in such a way that liquid sealing resin is filled (injected) into the frame body 32 and then cured. In this way, the sealing part 33 seals the light emitting elements 26, 26, . . . and the conductive wires 28, 28, . . . . Therefore, the frame body 32 has a function of determining the sealing part 33 into a predetermined shape by preventing the sealing resin from unnecessarily flowing toward the control elements 27, 27, . . . .

The refractive index of the sealing part 33 has an intermediate value between the refractive index of the light emitting elements 26, 26, . . . and the refractive index of air. Since the light emitting elements 26, 26, . . . are sealed by the sealing part 33, a difference between the refractive index of the light emitting elements 26, 26, . . . and the refractive index of air is alleviated. Therefore, the emission efficiency of light from the light emitting elements 26, 26, . . . to the outside is improved.

A lens part 34 is disposed on the sealing part 33. The lens part 34 is formed of a predetermined molding resin and has a hemispherical shape which is convex rearward. The lens part 34 is formed in such a manner that, for example, predetermined liquid molding resin is filled and cured on the sealing part 33 before curing or after curing on the inside of the frame body 32. Therefore, the frame body 32 also has a function of determining the lens part 34 into a predetermined shape by preventing the molding resin for forming the lens part 34 from unnecessarily flowing toward the control elements 27, 27, . . . .

The lens part 34 is formed in such a manner that the molding resin is filled and cured on the sealing part 33. Therefore, the frame body 32 also has a function of determining the lens part 34 into a predetermined shape by preventing the molding resin for forming the lens part 34 from unnecessarily flowing toward the control elements 27, 27, . . . .

Further, the refractive index of the lens part 34 has an intermediate value between the refractive index of the light emitting element 26 and the refractive index of air. Since the light emitted from the light emitting elements 26, 26, . . . is less likely to be totally reflected at the interface of the sealing part 33 and the lens part 34, it is possible to improve the emission efficiency of light from the light emitting elements 26, 26, . . . to the outside.

Furthermore, since the frame body 32 is provided, the sealing resin or molding resin is formed in a certain shape even in the case where the injection position of the sealing resin or molding resin is deviated from a predetermined position when the sealing resin or molding resin is injected to the inside of the frame body 32. Therefore, it is possible to improve the molding accuracy of the sealing resin or molding resin.

As described above, the light source unit 8 is provided with the frame body 32 which is attached to the substrate 25 and surrounds the light emitting elements 26, 26, . . . and the conductive wires 28, 28, . . . . The sealing part 33 is filled to the inside of the frame body 32 and a molding resin is applied on the sealing portion 33 and then cured. In this way, the lens part 34 is formed.

Therefore, since the light emitting elements 26, 26, . . . and the conductive wires 28, 28, . . . are sealed by the sealing part 33, and the light emitting elements 26, 26, . . . are covered by the lens part 34 having high molding accuracy, it is possible to secure a good mounting state of the light emitting elements 26, 26, . . . and to secure a good emission state of light which is emitted from the light emitting elements 26, 26, . . . and directed to the outside. In addition, an angle of the lens part 34 to the substrate 25, i.e., an angle "A" between an upper surface of the substrate 25 and a tangential line passing through a lower end of the lens part 34 is preferably in the range of 85° to 130°.

The molding resin has viscosity higher than that of the sealing resin and has liquidity-lower than that of the sealing resin. The viscosity of the molding resin is equal to or greater than 40 Pa·s (pascal-second), for example, and the viscosity of the sealing resin falls in the range of 5 to 15 Pa·s (pascal-second), for example.

When the viscosity of the molding resin is set to be equal to or greater than 40 Pa·s, the molding resin does not flow more than necessary when the molding resin is injected onto the sealing resin. Therefore, the shape of the lens part 34 is likely to be formed in a desired shape.

On the other hand, when the viscosity of the sealing resin is set to the range of 5 to 15 Pa·s, the sealing resin is flowing in a desired state when the sealing resin is injected onto the substrate 25. Therefore, it is easy to maintain a planar shape and it is possible to secure a good formability. Further, when the viscosity of the sealing resin is set to the range of 5 to 15 Pa·s, the load on the conductive wires 28, 28, . . . becomes small when the sealing resin is injected onto the substrate 25. Therefore, it is possible to suppress the occurrence of disconnection or the like of the conductive wires 28, 28, . . . .

As described above, in the light source unit 8, the viscosity of the molding resin is higher than that of the sealing part 33.

In this way, since the light emitting elements 26, 26, . . . and the conductive wires 28, 28, . . . are sealed by the sealing part 33 having low viscosity, and the light emitting elements 26, 26, . . . are covered by the lens part 34 having high molding accuracy, it is possible to secure a good mounting state of the light emitting elements 26, 26, . . . and to secure a good emission state of light which is emitted from the light emitting elements 26, 26, . . . and directed to the outside.

Meanwhile, when the sealing part 33 before curing is injected onto the substrate 25, the sealing part 33 is injected to the inside of the frame body 32 and the shape of the sealing part 33 is determined by the frame body 32. Therefore, the viscosity of the sealing part 33 may be less than 5 Pa·s.

Further, there is a case that the lens part 34 is formed by a mold and then disposed on the sealing part 33. In this case, since the lens part 34 is formed into a predetermined shape by the mold, the molding resin having a viscosity less than 40 Pas may be used.

The elastic modulus of the lens part 34 is higher than that of the sealing part 33. Preferably, when measured at room temperature (25° C.), the elastic modulus of the sealing part 33 is less than 1 MPa and the elastic modulus of the lens part 34 is equal to or greater than 1 Mpa.

Since the elastic modulus of the lens part 34 is higher than that of the sealing part 33, the molding resin for forming the lens part 34 does not flow more than necessary at the time of being injected onto the sealing resin, and hence, the lens part 34 is easily formed into a desired shape. Further, the sealing resin for forming the sealing part 33 is flowing in a desired state at the time of being injected onto the substrate 25. Therefore, it is easy to maintain a planar shape and it is possible to secure a good formability. Further, the load on the conductive wires 28, 28, . . . becomes small when the sealing resin is injected onto the substrate 25, and hence, it is possible to suppress the occurrence of disconnection or the like of the conductive wires 28, 28, . . . .

As described above, in the light source unit 8, the elastic modulus of the lens part 34 is higher than that of the sealing part 33.

In this way, since the light emitting elements 26, 26, . . . and the conductive wires 28, 28, . . . are sealed by the sealing part 33 having low elastic modulus, and the light emitting elements 26, 26, . . . are covered by the lens part 34 having high molding accuracy, it is possible to secure a good mounting state of the light emitting elements 26, 26, . . . and to secure a good emission state of light which is emitted from the light emitting elements 26, 26, . . . and directed to the outside.

In the state where the lens part 34 is disposed, the light emitting elements 26, 26, . . . and the conductive wires 28, 28, . . . are covered by the lens part 34 in a state of being sealed by the sealing part 33.

Meanwhile, an example where the frame body 32 is formed of a resin material has been illustrated in the above description. However, the frame body 32 may be formed of a metallic material. Further, the frame body 32 may be formed of a resin material and the surface thereof may be subjected to processing such as metal deposition. Furthermore, the frame body 32 may be formed of a white resin. By configuring the frame body 32 in this structure, the frame body 32 can serve as a reflector to reflect a portion of light emitted from the light emitting elements 26, 26, . . . .

In this way, since the frame body 32 has both a function of determining the shapes of the sealing part 33 and the lens part 34 and a function of reflecting light, it is possible to improve the functionality of the light source unit 8 without increasing the number of parts.

Figure 8:
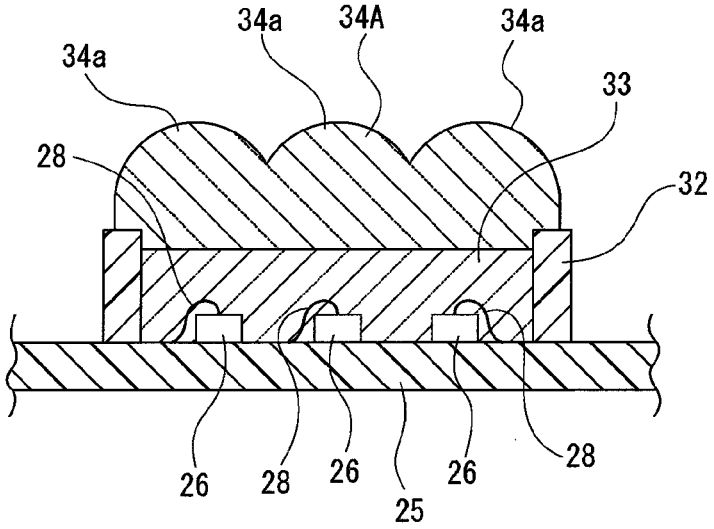
FIG. 8 is a sectional view showing a lens part or the like, which is provided with convex portions corresponding to respective light emitting elements.

Further, in the above embodiment, the hemispherical lens part 34 has been described as an example. However, for example, instead of the lens part 34, a lens part 34A having a shape corresponding to the light emitting elements 26, 26, . . . may be used (see FIG. 8). The lens part 34A has a plurality of protrusions 34*a*, 34*a*, . . . corresponding to the light emitting elements 26, 26, . . . .

When the lens part 34A is used, the light emitted from the light emitting elements 26, 26, . . . is emitted to the outside by being respectively controlled by the protrusions 34*a*, 34*a*, . . . . Therefore, it is possible to improve freedom in forming the light distribution pattern.

In the light source unit 8 configured as described above, an annular gasket 36 is fitted and attached to the outside of the protrusion-shaped portion 15 (see FIG. 4). The gasket 36 is formed of a resin material or a rubber material. In the state where the gasket 36 is attached to the light source unit 8, the protrusion-shaped portion 15 is inserted to the unit mounting portion 6 of the lamp body 2 from the front and is rotated in the circumferential direction. In this way, the engaging portions 20, 20, . . . are respectively engaged with the engaging protrusions 7, 7, . . . from the rear (see FIG. 1). At this time, the engaging protrusions 7, 7, . . . are clamped in the engaging portions 20, 20, . . . and the gasket 36, and hence, the light source unit 8 is attached to the lamp body 2. In the state where the light source unit 8 is attached to the lamp body 2, the unit mounting portion 6 is closed by the gasket 36, and hence, foreign matters such as moisture are prevented from entering the lamp chamber 5 through the unit mounting portion 6 from the outside.

On the contrary, when the light source unit 8 is rotated in a direction opposite to the above direction along the circumferential direction, the engagement of the engaging portions 20, 20, . . . to the engaging protrusions 7, 7, . . . is released, and hence, the protrusion-shaped portion 15 can be pulled from the unit mounting portion 6. In this way, the light source unit 8 can be detached from the lamp body 2.

When current is supplied to the wiring pattern through the connection terminals 22, 22, 22 from the power supply circuit in the state where the light source unit 8 is attached to the lamp body 2, light is emitted from at least one light emitting element 26. At this time, when the vehicle lamp 1 serves as a tail lamp, light is emitted from one light emitting element 26 located at the center. Further, when the vehicle lamp 1 serves as a stop lamp, light is emitted from four light emitting elements 26, 26, . . . other than the one located at the center.

The light emitted from the light emitting element 26 is transmitted through the sealing part 33 and the lens part 34 and is irradiated to the outside through the cover 3. At this time, the irradiation direction of the light is controlled by the lens part 34, so that the light is irradiated to the outside toward a predetermined direction. At this time, when the frame body 32 serves as a reflector, a portion of the light emitted from the light emitting element 26 is irradiated to the outside by being reflected in the frame body 32.

At the time of emission of the light from the light emitting element 26, heat is generated in the light emitting module 11. However, the generated heat is transmitted to the first heat-dissipation portion 13*a* through the adhesive 30 having excellent thermal conductivity, and is transmitted to the heat-dissipation plate 13 and the resin molding part 12. The heat, which is transmitted to the heat-dissipation plate 13 and the resin molding part 12, is mainly dissipated to the outside from the first heat-dissipation fins 16, 16, . . . and the second heat-dissipation fins 17, 17.

Hereinafter, each example of configurations for sealing the light emitting elements 26, 26, . . . and the conductive wires 28, 28, . . . will be described.

First, a first example where the sealing part 33 is filled to the inside of the frame body 32 and the lens part 34 previously formed by a mold or the like is disposed on the sealing part 33 (see FIGS. 9 to 12) will be described. Since the lens part 34 previously formed is formed by the mold, the high molding accuracy of the lens part 34 is secured.

Figure 9:
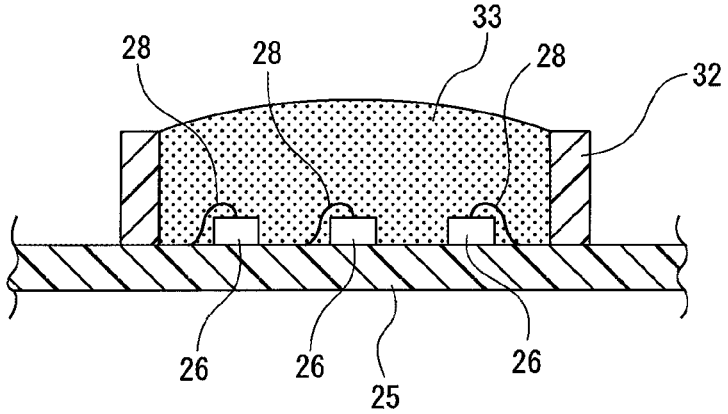
FIG. 9 is a schematic enlarged sectional view showing a state where a sealing resin is filled to the inside of a frame body, showing a first example where the lens part previously formed is disposed on the sealing part, together with FIGS. 10 to 12.

In the first example, the sealing part 33 is filled so as to fill the entire internal space of the frame body 32 (see FIG. 9). At this time, the sealing part 33 is in the state where the central portion is raised by the surface tension.

Figure 10:
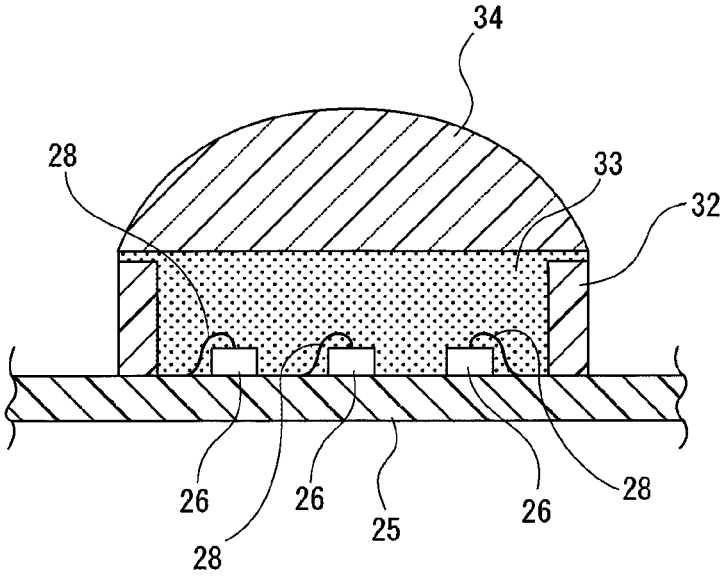
FIG. 10 is a schematic enlarged sectional view showing a state where the lens part is disposed on the sealing part filled to the inside of the frame body.

Subsequently, the lens part 34 is pressed against the sealing part 33 before the sealing part 33 is cured (see FIG. 10). When the lens part 34 is pressed against the sealing part 33, a portion of the sealing part 33 is extruded from the portion between the frame body 32 and an outer peripheral surface of the lens part 34. As the sealing part 33 is cured, not only the portion of the sealing part 33 pressed against the lens part 34, but also the extruded portion thereof is bonded to the lens part 34. The curing of the sealing part 33 is performed, for example, by the heating of the sealing part 33.

Since the lens part 34 is bonded to the frame body 32 by being pressed against the sealing part 33 in this way, the lens part 34 and the frame body 32 can be easily bonded and the light source unit 8 can be easily formed.

Figure 11:
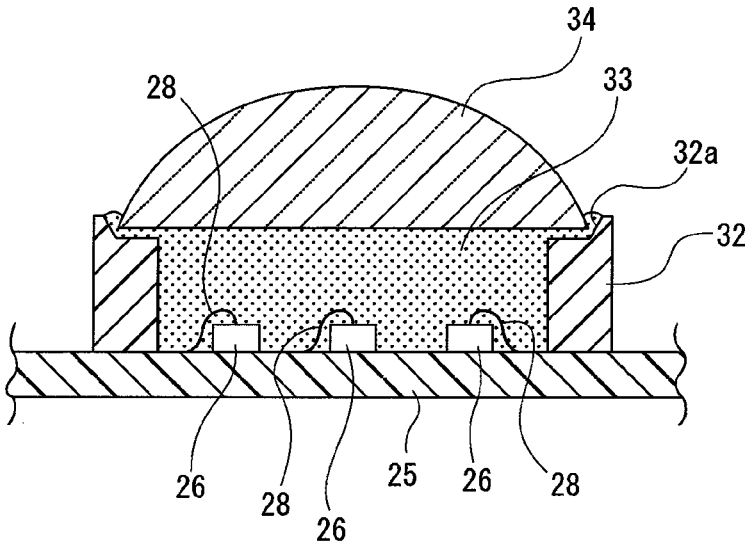
FIG. 11 is a schematic enlarged sectional view showing a state where the lens part is disposed on the sealing part filled to the inside of the frame body provided with a step.

Further, as shown in FIG. 11, a positioning step 32*a* extending in a circumferential direction may be formed in the frame body 32, and the lens part 34 may be attached to the frame body 32 in a state of being positioned relative to the frame body 32 by the step 32*a*.

Figure 12:
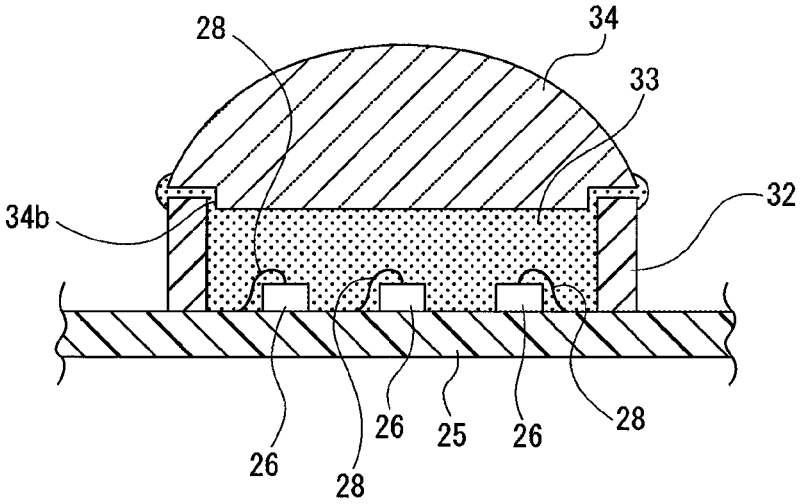
FIG. 12 is a schematic enlarged sectional view showing a state where the lens part provided with a step is disposed on the sealing part filled to the inside of the frame body.

On the contrary, as shown in FIG. 12, a positioning step 34*b* extending in the circumferential direction may be formed in the lens part 34, and the lens part 34 may be attached to the frame body 32 in a state of being positioned relative to the frame body 32 by the step 34*b*.

When the step 32*a* or the step 34*b* is formed in this way, the assembly property of the lens part 34 to the frame body 32 can be improved and the positional accuracy of the lens part 34 to the frame body 32 can be improved.

Next, a second example where the frame body 32 is not provided will be described (see FIGS. 13 to 15).

Figure 13:
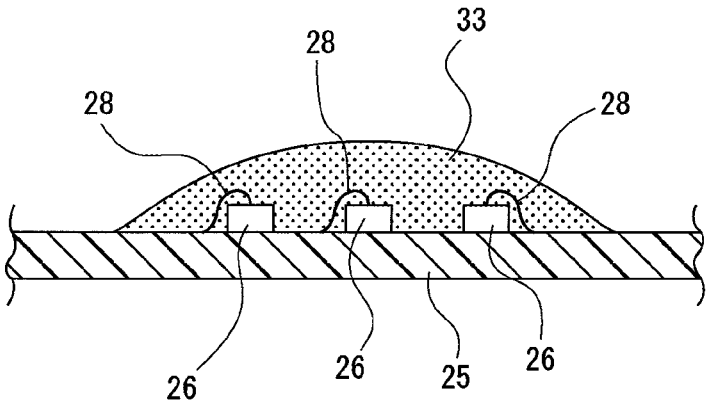
FIG. 13 is a schematic enlarged sectional view showing a state where a sealing resin is applied on a substrate, showing a second example where a frame body is not provided, together with FIGS. 14 and 15.
Figure 14:
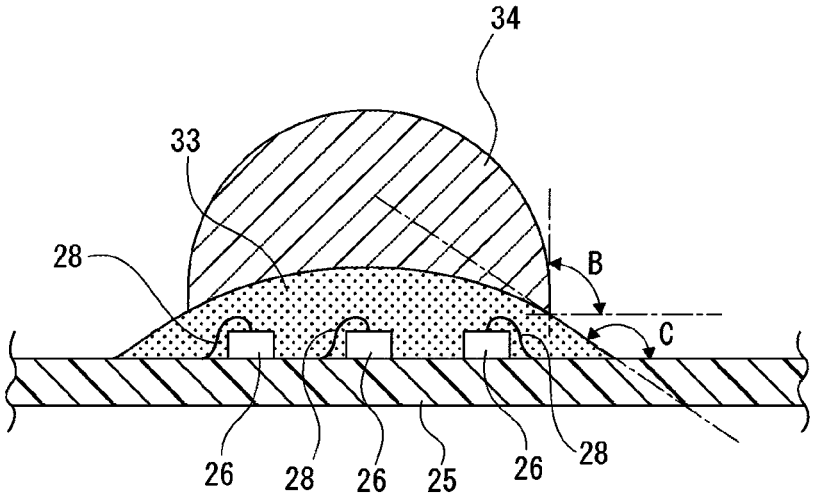
FIG. 14 is a schematic enlarged sectional view showing a state where a molding resin is applied on the sealing part, and the lens part is formed.

In the second example, the sealing part 33 is applied onto the substrate 25 in the state where the frame body 32 is not provided (see FIG. 13). The sealing part 33 applied onto the substrate 25 is in the state of covering the entire of the light emitting elements 26, 26, . . . and the conductive wires 28, 28, . . . . An application area of the sealing part 33 on the substrate 25 is increased, as compared to a case where the frame body 32 is provided.

Subsequently, the sealing part 33 is heated until reaching certain hardness. For example, the sealing part 33 is in a temporarily cured state by being heated for 10 minutes at 150° C.

Subsequently, a molding resin is applied onto the sealing part 33 (see FIG. 14). The molding resin applied has viscosity higher than that of the sealing part 33 and has a substantially hemispherical shape.

Subsequently, the sealing part 33 and the molding resin are simultaneously heated, for example, for 180 minutes at 150° C. When the sealing part 33 and the molding resin are simultaneously heated, the molding resin is cured with the curing of the sealing part 33, thereby forming the lens part 34. As the sealing part 33 and the molding resin are heated and cured, the sealing part 33 and the lens part 34 are bonded.

When, as in the second example, the sealing part 33 and the molding resin are heated and cured in the state where the sealing part 33 is temporarily cured, the entire heating time can be shortened, and thus, the manufacturing time of the light source unit 8 can be shortened, as compared to a case where the sealing part 33 is cured and then the molding resin is cured.

Further, since the sealing part 33 and the lens part 34 are bonded by simultaneous heating of the sealing part 33 and the molding resin, an adhesive for bonding the lens part 34 to the sealing part 33 is not necessary. Therefore, the manufacturing cost can be reduced and the bonding time is not necessary. As a result, it is possible to further shorten the manufacturing time of the light source unit 8.

In the above second example, the molding resin is applied onto the sealing part 33 to form the lens part 34. However, for example, the lens part 34 previously formed by a mold or the like may be placed on the sealing part 33 (see FIGS. 13 and 15).

Figure 15:
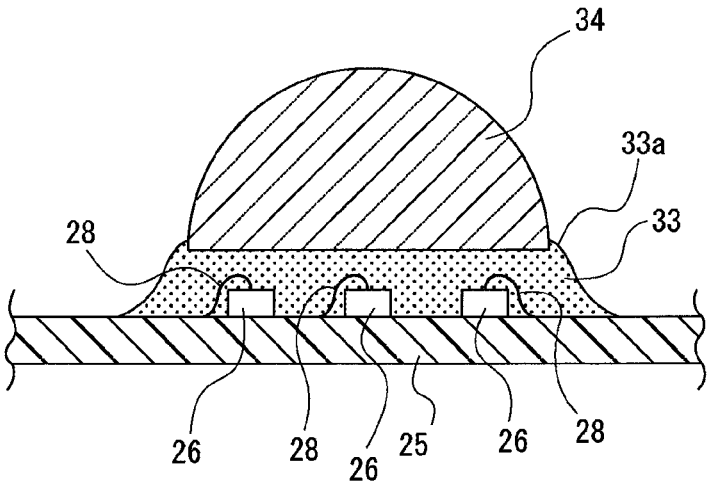
FIG. 15 is a schematic enlarged sectional view showing a state where the lens part previously formed is disposed on the sealing part.

In this case, as described above, in the state where the sealing part 33 is applied onto the substrate 25 (see FIG. 13), the sealing part 33 is in the temporarily cured state by being heated until reaching certain hardness and the lens part 34 previously formed is placed on the sealing part 33 (see FIG. 15).

The lens part 34 disposed on the sealing part 33 is previously formed and cured. Therefore, when the lens part 34 is placed on the sealing part 33, the sealing part 33 is pressed by the lens part 34 and the portion of the sealing part 33 on the outer peripheral side of the lens part 34 is raised and formed as a raised portion 33*a*. In addition, an angle "B" between an upper surface of the substrate 25 and a tangential line passing through a lower end of the lens part 34 is preferably in the range of 85° to 130° and an angle "C" between the upper surface of the substrate 25 and a tangential line passing through a lower end of the sealing part 33 is preferably in the range of 130° to 170°.

Subsequently, the sealing part 33 is heated, for example, for 180 minutes at 150° C. The sealing part 33 and the lens part 34 are bonded with the curing of the sealing part 33.

When, in this way, the lens part 34 is disposed and the sealing part 33 is heated and cured in the state where the sealing part 33 is temporarily cured, the entire heating time can be shortened, and thus, the manufacturing time of the light source unit 8 can be shortened, as compared to a case where the sealing part 33 is cured and then the molding resin is cured.

Further, since the sealing part 33 and the lens part 34 are bonded by the heating of the sealing part 33, an adhesive for bonding the lens part 34 to the sealing part 33 is not necessary. Therefore, the manufacturing cost can be reduced and the bonding time is not necessary. As a result, it is possible to further shorten the manufacturing time of the light source unit 8.

Furthermore, since not only the portion of the sealing part 33 pressed against the lens part 34, but also the raised portion 33*a* is bonded to the lens part 34, it is possible to secure a robust bonding state of the sealing part 33 and the lens part 34.

Next, a third example where the lens part 34 also has a function of the sealing part 34 will be described (see FIGS. 16 to 18).

Figure 16:
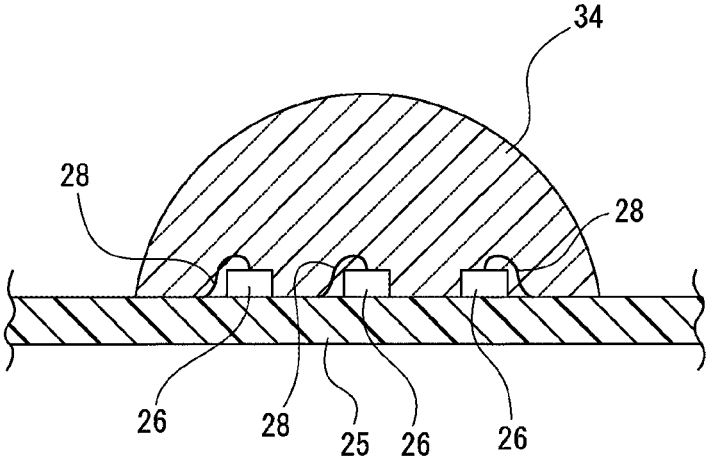
FIG. 16 is a schematic enlarged sectional view showing a state where a molding resin is applied on a substrate and a lens part is formed, showing a third example where the lens part also has a function of the sealing resin, together with FIGS. 17 and 18.

In the third example, the molding resin is applied onto the substrate 25 (see FIG. 16). The molding resin applied onto the substrate 25 is formed into a hemispherical shape, for example. The entire of the light emitting elements 26, 26, . . . and the conductive wires 28, 28, . . . are covered by the molding resin.

Subsequently, the molding resin is heated and cured, and thus, the lens part 34 is formed. The light emitting elements 26, 26, . . . and the conductive wires 28, 28, . . . are sealed by the lens part 34.

By adopting the configuration that the molding resin is heated and cured, and thus, the lens part 34 is formed, and the light emitting elements 26, 26, . . . and the conductive wires 28, 28, . . . are sealed by the lens part 34 in this way, the manufacturing cost of the light source unit 8 can be reduced and the manufacturing time thereof can be shortened.

Figure 17:
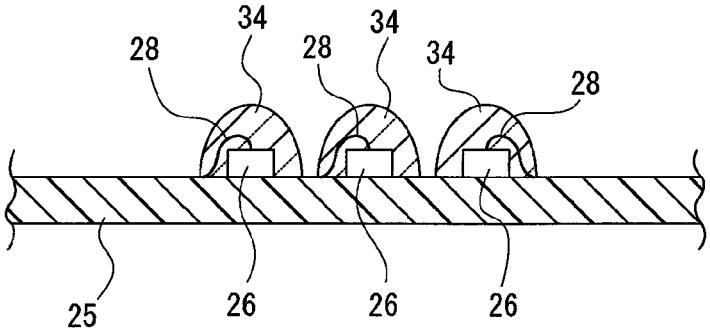
FIG. 17 is a schematic enlarged sectional view showing a state where one light emitting element and one conductive wire are provided as one set and the lens part is formed for each set.

In addition, in the other configuration in which the light emitting elements 26, 26, . . . and the conductive wires 28, 28, . . . are sealed by the lens part 34, one light emitting element 26 and one conductive wire 28 are provided as one set, as shown in FIG. 17. In this case, a plurality of lens parts 34, 34, . . . is provided.

By adopting the configuration in which one light emitting element 26 and one conductive wire 28 are provided as one set and each set is sealed by the lens part 34 in this way, the amount of the molding resin can be reduced, and thus, the manufacturing cost of the light source unit 8 can be reduced.

Figure 18:
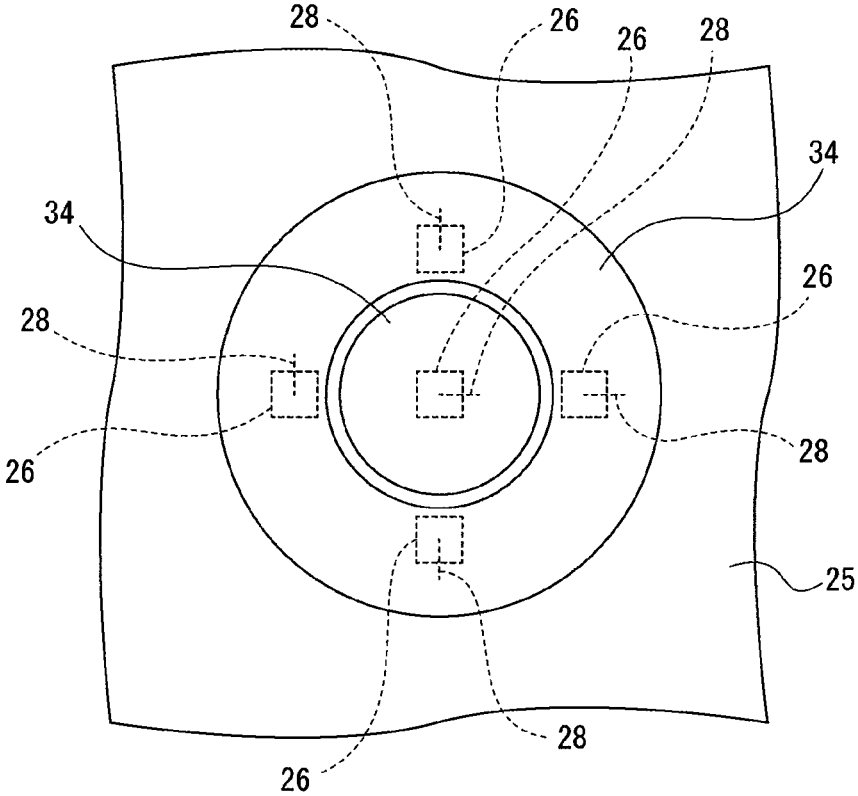
FIG. 18 is a schematic enlarged sectional view showing a state where the lens part is formed for each type and function of the light emitting element.

Further, the configuration in which the light emitting elements 26, 26, . . . and the conductive wires 28, 28, . . . are sealed by the lens part 34 may be applied for each type and function of the light emitting elements 26, 26, . . . , as shown in FIG. 18. For example, the light source unit 8 can be provided with the light emitting element 26 (as a first light emitting element) serving as a light source for a tail lamp and the light emitting elements 26, 26 (as second light emitting elements) serving as a light source for a stop lamp. The first light emitting element 26 and the conductive wire 28 for the tail lamp are sealed by the lens part 34 and the second light emitting elements 26, 26, . . . and the conductive wires 28, 28, . . . for the stop lamp are sealed by another lens part 34.

When the first light emitting element 26 and the second light emitting elements 26, 26, . . . are separately sealed by the lens parts 34, 34 as described above, the shape, size and type of the lens parts 34, 34 can be changed in accordance with the function of the light emitting elements 26, 26, . . . . Therefore, it is possible to improve the degree of freedom for design.

Next, a fourth example where two kinds of resin having different viscosity are used will be described (see FIGS. 19 to 23).

Figure 19:
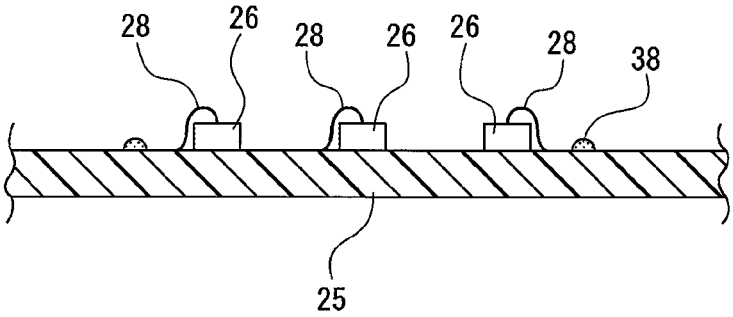
FIG. 19 is a schematic enlarged sectional view showing a state where a high modulus resin is applied around a plurality of socket housings, showing a fourth example where two kinds of resin having different viscosity is used, together with FIGS. 20 to 23.

In the fourth example, a resin 38 having elastic modulus higher than that of the molding resin is applied around the light emitting elements 26, 26, . . . on the substrate 25 in the state where the frame body 32 is not provided (see FIG. 19). The high modulus resin 38 applied on the substrate 25 has an annular shape in the state of being applied on the substrate 25.

Subsequently, the high modulus resin 38 is heated until reaching certain hardness. The high modulus resin 38 is in the temporarily cured state by being heated, for example, for 10 minutes at 150° C.

Figure 20:
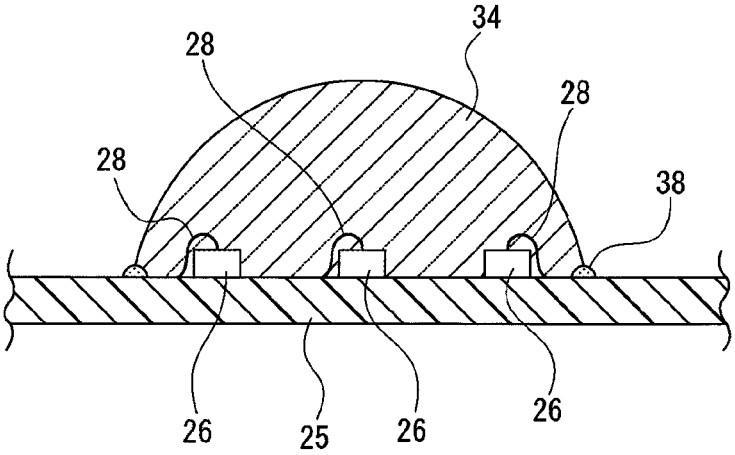
FIG. 20 is a schematic enlarged sectional view showing a state where a molding resin is applied on the substrate and a lens part is formed.

Subsequently, the molding resin is applied to the inside of the high modulus resin 38 (see FIG. 20). The molding resin applied has a substantially hemispherical shape.

Subsequently, the high modulus resin 38 and the molding resin are simultaneously heated, for example, for 180 minutes at 150° C. When the high modulus resin 38 and the molding resin are simultaneously heated, the molding resin is cured with the curing of the high modulus resin 38, and thus, the lens part 34 is formed. As the high modulus resin 38 and the molding resin are heated and cured, the high modulus resin 38 and the lens part 34 are bonded. The light emitting elements 26, 26, . . . and the conductive wires 28, 28, . . . are sealed by the lens part 34.

When, as in the fourth example, the high modulus resin 38 and the molding resin are heated and cured in the state where the high modulus resin 38 is temporarily cured, the entire heating time can be shortened, and thus, the manufacturing time of the light source unit 8 can be shortened, as compared to a case where the high modulus resin 38 is cured and then the molding resin is cured.

Further, since the high modulus resin 38 and the lens part 34 are bonded by simultaneous heating of the high modulus resin 38 and the molding resin, an adhesive for bonding the lens part 34 to the high modulus resin 38 is not necessary.

Therefore, the manufacturing cost can be reduced and the bonding time is not necessary. As a result, it is possible to further shorten the manufacturing time of the light source unit 8.

Furthermore, since the high modulus resin 38 serves as a base for preventing the unnecessary spread of the molding resin on the substrate 25, it is possible to improve the molding accuracy of the lens part 34.

Figure 21:
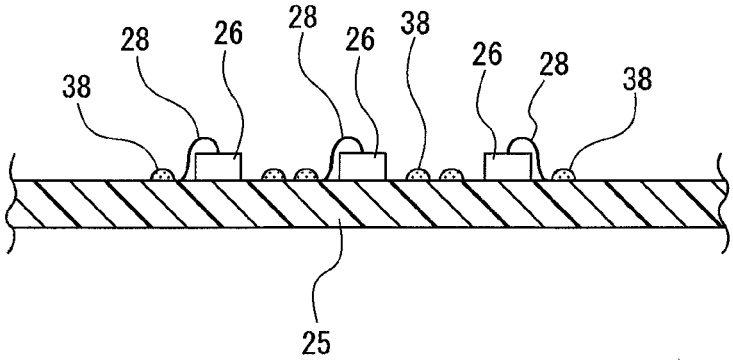
FIG. 21 is a schematic enlarged sectional view showing a state where a high modulus resin is applied around respective socket housings.
Figure 22:
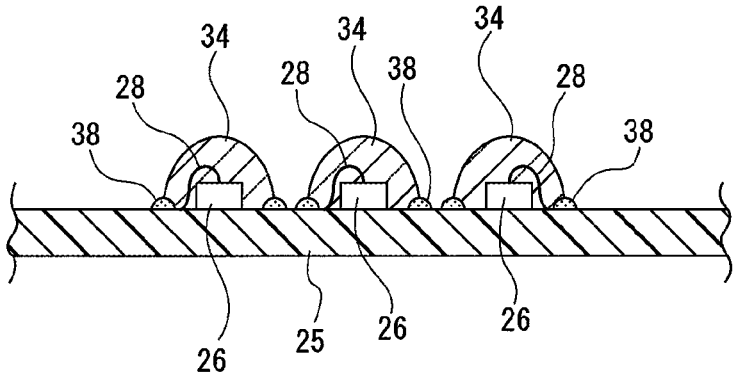
FIG. 22 is a schematic enlarged sectional view showing a state where a molding resin is respectively applied on the substrate and a plurality of lens parts is formed.

Meanwhile, similar to the third example, also in the fourth example, the above configuration can be applied. One light emitting element 26 and one conductive wire 28 can be provided as one set, as shown in FIGS. 21 and 22. In this case, a plurality of lens parts 34, 34, . . . is provided.

By adopting the configuration that one light emitting element 26 and one conductive wire 28 are provided as one set and each set is sealed by the lens part 34 in this way, the amount of the molding resin can be reduced, and thus, the manufacturing cost of the light source unit 8 can be reduced.

Further, similar to the third example, also in the fourth example, the light emitting elements 26, 26, . . . and the conductive wires 28, 28, . . . are sealed by the lens part 34 for each type and function of the light emitting elements 26, 26, . . . . For example, the first light emitting element 26 and the conductive wire 28 for the tail lamp can be sealed by the lens part 34, and the second light emitting elements 26, 26, . . . and the conductive wires 28, 28, . . . for the stop lamp can be sealed by another lens part 34.

When the first light emitting element 26 and the second light emitting elements 26, 26, . . . are separately sealed by the lens parts 34, 34 in this way, the shape, size and type of the lens parts 34, 34 can be changed in accordance with the function of the light emitting elements 26, 26, . . . . Therefore, it is possible to improve freedom for design.

Figure 23:
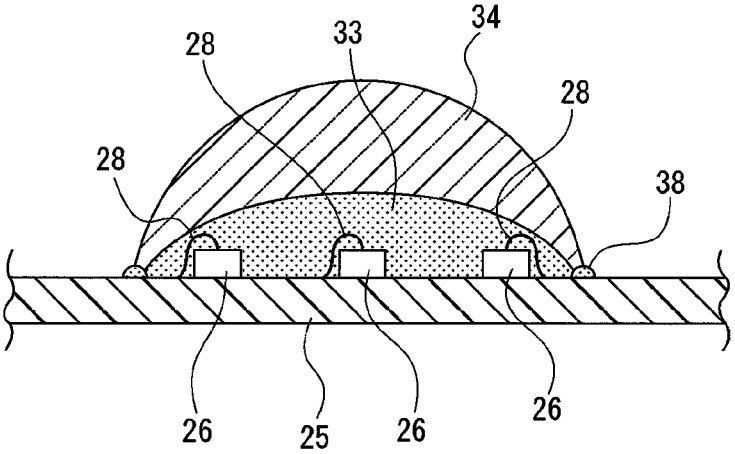
FIG. 23 is a schematic enlarged sectional view showing a state where a sealing resin and a molding resin are respectively applied on the substrate and a lens part is formed.

Furthermore, also in the fourth example, before or after the sealing part 33 is cured on the substrate 25, the molding resin may be applied onto the sealing part 33, and hence, the lens part 34 may be formed (see FIG. 23). Meanwhile, the elastic modulus of the molding resin is higher than that of the sealing resin.

Next, a fifth example where a lens part 34B previously formed by a mold or the like is disposed on the sealing part 33 in the state where the frame body 32 is not provided will be described (see FIGS. 24 to 30).

Figure 24:
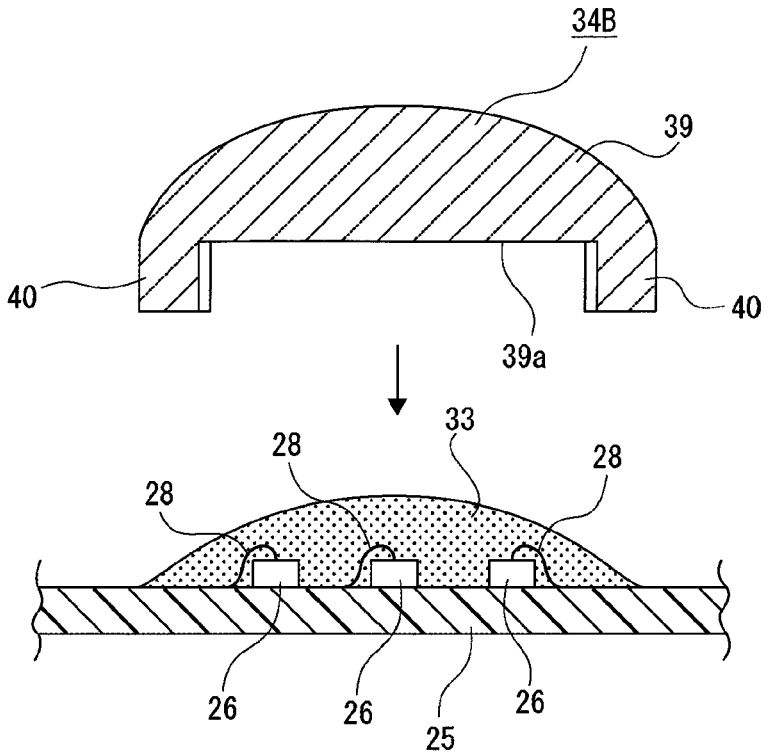
FIG. 24 is a schematic enlarged sectional view showing a state where a sealing resin is filled to the substrate and before a lens part is disposed, showing a fifth example where the lens part previously formed is disposed on the sealing resin in the state where a frame body is not provided, together with FIGS. 25 to 30.

In the fifth example, first, the sealing part 33 is applied onto the substrate 25, similar to the second example (see FIG. 24). The sealing part 33 applied onto the substrate 25 is in the state of covering the entire of the light emitting elements 26, 26, . . . and the conductive wires 28, 28, . . . .

Figure 25:
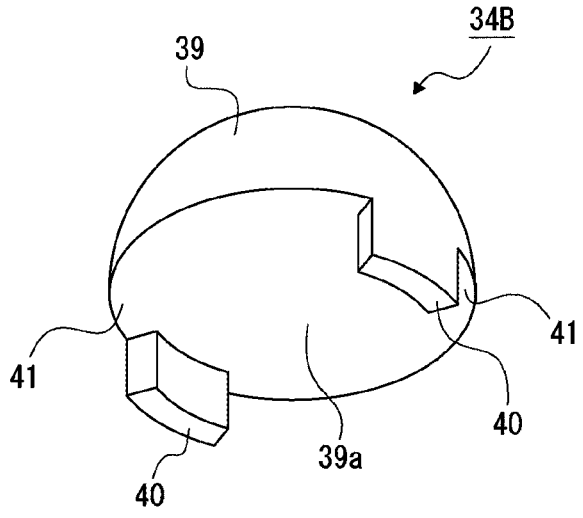
FIG. 25 is a perspective view of the lens part.

Subsequently, the lens part 34B is pressed against the sealing part 33 before the curing of the sealing part 33. As shown in FIG. 25, the lens part 34B is integrally formed by a hemispherical cover lens portion 39 and leg portions 40, 40 protruding from an outer peripheral portion of the cover lens portion 39. The surface of the cover lens portion 39, from which the leg portions 40, 40 protrude, is formed, for example, as a planar pressing surface 39*a*. The leg portions 40, 40 are positioned at 180° opposite sides in the outer peripheral surface of the cover lens portion 39, for example. Circumferential spaces of the lens part 34B between the leg portions 40, 40 are formed as opening portions 41, 41 for communicating an inner side and an outer side of the leg portions 40, 40.

Figure 26:
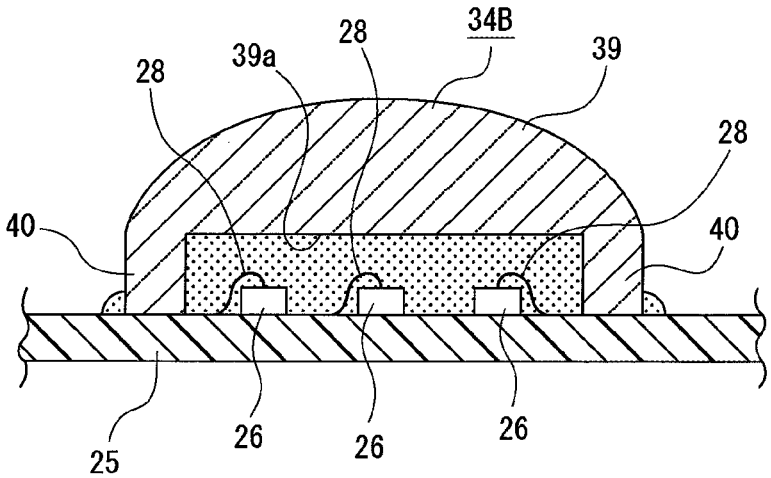
FIG. 26 is a schematic enlarged sectional view showing a state where the lens part is pressed against a sealing resin filled to the substrate.

When the lens part 34B is pressed against the sealing part 33, the sealing part 33 is in close contact with the pressing surface 39*a* and a portion of the sealing part 33 is extruded to the outside of the lens part 34B from the opening portions 41, 41 (see FIG. 26). In the state where the lens part 34B is pressed against the sealing part 33, the light emitting elements 26, 26, . . . and the conductive wires 28, 28, . . . are positioned between the pressing surface 39*a* and the substrate 25, and leading end surfaces of the leg portions 40, 40 are respectively in contact with the substrate 25.

Subsequently, the sealing part 33 is cured, so that the lens part 34B and the sealing part 33 are bonded. The curing of the sealing part 33 is performed by the heating of the sealing part 33, for example.

Since the cover lens portion 39 is pressed against the sealing part 33 and a portion of the sealing part 33 is extruded from the opening portions 41, 41 in this way, the pressing surface 39*a* is in close contact with the sealing part 33, and thus, unnecessary voids are less likely to occur between the pressing surface 39*a* and the sealing part 33. As a result, it is possible to secure a good light-emitting state of light which is emitted from the light emitting elements 26, 26, . . . and transmitted through the cover lens portion 39.

Further, since die light emitting elements 26, 26, . . . and the conductive wires 28, 28, . . . are sealed by the sealing part 33 and the light emitting elements 26, 26, . . . are covered by the lens part 34 previously formed and having high molding accuracy, it is possible to secure a good mounting state of the light emitting elements 26, 26, . . . and to secure a good emission state of light which is emitted from the light emitting elements 26, 26, . . . and directed to the outside.

Hereinafter, each of the modified examples of the lens part will be described (see FIGS. 27 to 30).

Figure 27:
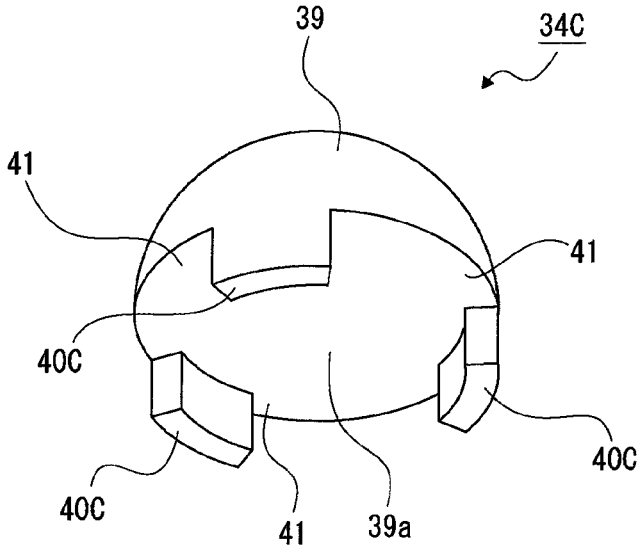
FIG. 27 is a perspective view showing a lens part according to a first modified example.

A lens part 34C according to a first modified example is integrally formed by the cover lens portion 39 and leg portions 40C, 40C, 40C protruding from an outer peripheral portion of the cover lens portion 39 (see FIG. 27). The leg portions 40C, 40C, 40C are arranged at equal intervals in the circumferential direction. Circumferential spaces of the lens part 34C among the leg portions 40C, 40C, 40C are formed as the opening portions 41, 41, 41.

Since the lens part 34C is configured such that three leg portions 40C, 40C, 40C are arranged at equal intervals in the circumferential direction, the lens part 34C can be stably positioned in the substrate 25, and hence, it is possible to improve the positional accuracy of the cover lens portion 39 to the substrate 25.

Figure 28:
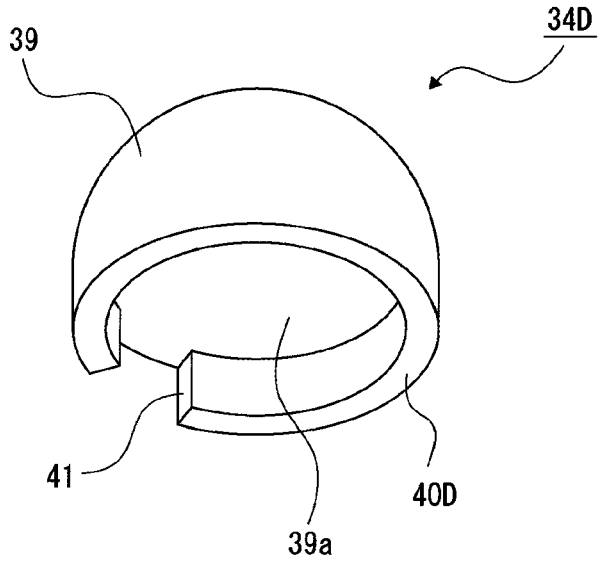
FIG. 28 is a perspective view showing a lens part according to a second modified example.

A lens part 34D according to a second modified example is integrally formed by the cover lens portion 39 and a leg portion 40D protruding from an outer peripheral portion of the cover lens portion 39 (see FIG. 28). The leg portion 40D is formed in an arc shape extending long in the circumferential direction. A space between both end surfaces in the circumferential direction of the leg portion 40D is formed as an opening portion 41.

Since the lens part 34D is provided with the leg portion 40D which is formed in the arc shape extending long in the circumferential direction, the lens part 34D can be stably positioned in the substrate 25, and hence, it is possible to improve the positional accuracy of the cover lens portion 39 to the substrate 25.

Figure 29:
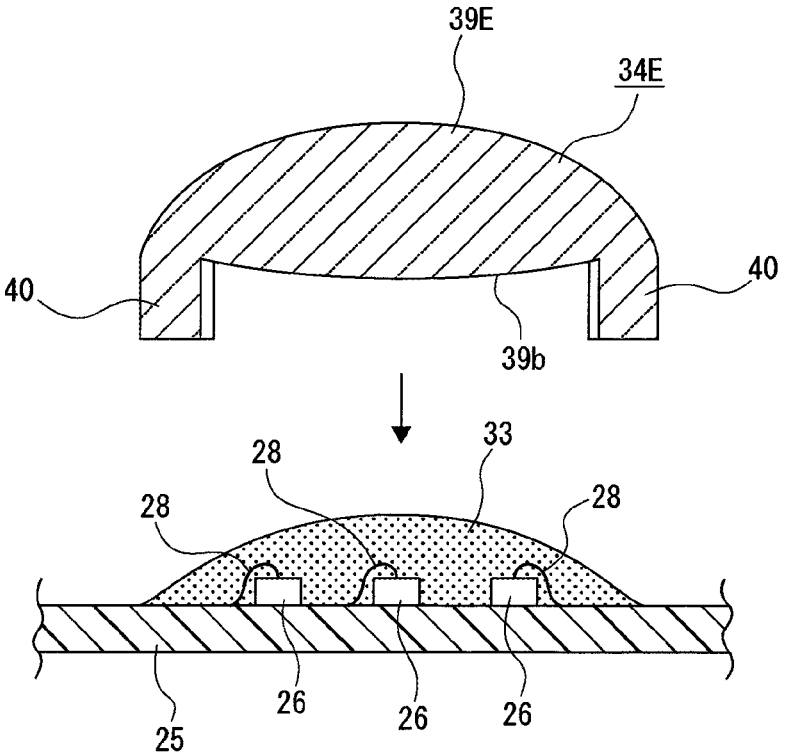
FIG. 29 is a schematic enlarged sectional view showing a lens part or the like according to a third modified example.

A lens part 34E according to a third modified example is integrally formed by a substantially hemispherical cover lens portion 39E and the leg portions 40, 40 protruding from an outer peripheral portion of the cover lens portion 39E (see FIG. 29). In addition, the number of the leg portion 40 need not be limited to two, but may be one, or three or more, similar to the lens part 34C according to the first modified example or the lens part 34D according to the second modified example.

The surface of the cover lens portion 39E, from which the leg portions 40, 40 protrude, is formed as a curved pressing surface 39*b* which is gently convex toward the substrate 25.

Circumferential spaces between the leg portions 40, 40 are formed as the opening portions 41, 41.

When the lens part 34E is pressed against the sealing part 33, the sealing part 33 is in close contact with the pressing surface 39*b* and a portion of the sealing part 33 is extruded to the outside of the lens part 34E from the opening portions 41, 41. At this time, the curved pressing surface 39*b*, which is convex toward the substrate 25, is pressed against the sealing part 33. Therefore, a portion of the sealing part 33 is extruded to the outside of the leg portions 40, 40 from the opening portions 41, 41, and the sealing part 33 is moved to the outer peripheral side by the pressing surface 39*b*.

Since the lens part 34E is formed with the curved pressing surface 39*b* which is convex toward the substrate 25 in this way, unnecessary voids are less likely to occur between the pressing surface 39*b* and the sealing part 33. As a result, it is possible to secure a good light-emitting state of light which is emitted from the light emitting elements 26, 26, . . . and transmitted through the cover lens portion 39.

Figure 30:
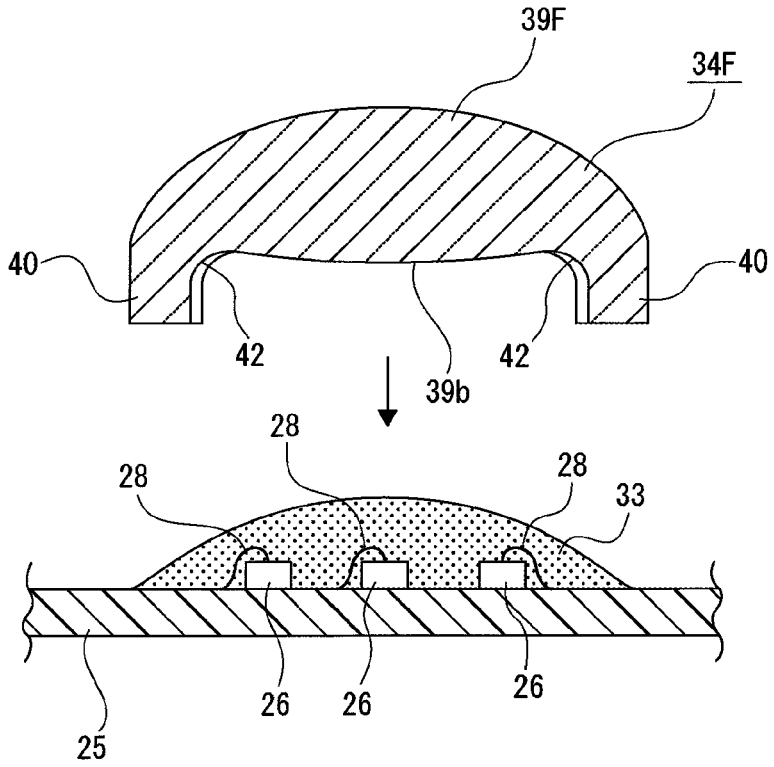
FIG. 30 is a schematic enlarged sectional view showing a lens part or the like according to a fourth modified example.

A lens part 34F according to a fourth modified example is integrally formed by a substantially hemispherical cover lens portion 39F and the leg portions 40, 40 protruding from an outer peripheral portion of the cover lens portion 39E (see FIG. 30). In addition, the number of the leg portion 40 need not be limited to two, but may be one, or three or more, similar to the lens part 34C according to the first modified example or the lens part 34D according to the second modified example.

The surface of the cover lens portion 39F, from which the leg portions 40, 40 protrude, is formed as a curved pressing surface 39*b* which is gently convex toward the substrate 25. Circumferential spaces between the leg portions 40, 40 are formed as the opening portions 41, 41. Boundary portions between the pressing surface 39*b* and the inner surfaces of the leg portions 40, 40 are formed as curved surface portions 42, 42.

In addition, instead of the curved pressing surface 39*b*, the planar pressing surface 39*a* may be formed in the cover lens portion 39F of the lens part 34F.

When the lens part 34F is pressed against the sealing part 33, the sealing part 33 is in close contact with the pressing surface 39*b* and the curved surface portions 42, 42, and a portion of the sealing part 33 is extruded to the outside of the lens part 34F from the opening portions 41, 41. At this time, the curved pressing surface 39*b*, which is convex toward the substrate 25, is pressed against the sealing part 33. Therefore, a portion of the sealing part 33 is extruded to the outside of the leg portions 40, 40 from the opening portions 41, 41, and the sealing part 33 is moved to the outer peripheral side by the pressing surface 39*b*.

Since, in the lens part 34F, boundary portions between the pressing surface 39*b* and the inner surfaces of the leg portions 40, 40 are formed as the curved surface portions 42, 42 in this way, unnecessary voids are less likely to occur not only between the pressing surface 39*b* and the sealing part 33 but also in the boundary portions between the pressing surface 39*b* and the inner surfaces of the leg portions 40, 40. As a result, it is possible to further secure a good light-emitting state of light which is emitted from the light emitting elements 26, 26, . . . and transmitted through the cover lens portion 39.

Hereinafter, a formation example of the frame body 32 arranged on the substrate 25 will be described (see FIGS. 31 to 35).

The frame body 32 is previously formed as a molded product by a resin material, and then, is attached to the substrate 25, as described above. However, in the following manner, the frame body 32 may be formed by the flowable resin being applied on the substrate 25. Meanwhile, in the drawings to be referred below, the control element 27 mounted (formed) on the frame body 32 or the substrate 25 is schematically shown so as to facilitate the understanding of description.

Figure 31:
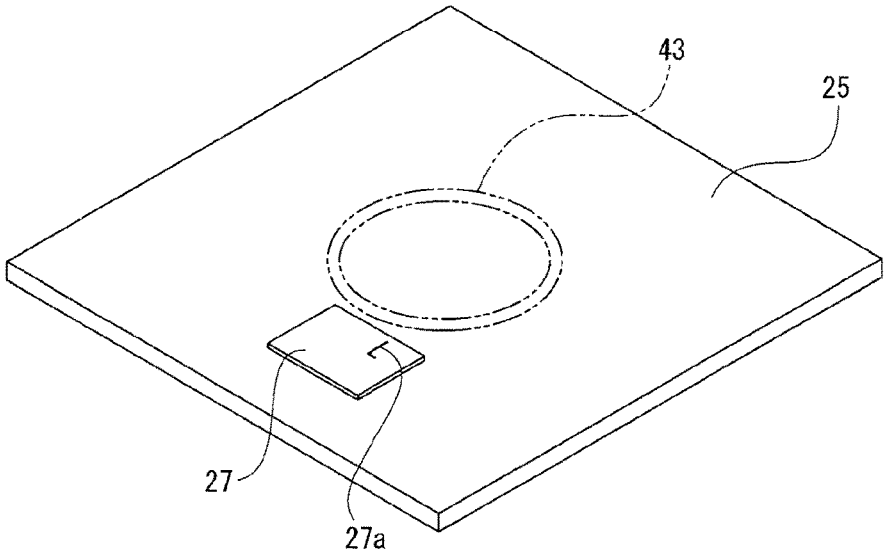
FIG. 31 is a perspective view showing a state before the frame body is formed, showing an example where the frame body is formed by flowable resin being applied on the substrate, together with FIGS. 32 to 35.

On the substrate 25, the control element 27 is mounted on the outside (on the outer peripheral side) of a frame body forming part 43 that is a part on which the frame body 32 is formed (see FIG. 31). As described above, the control element 27 is, for example, a diode, a capacitor, or a resistor or the like. When the control element 27 is a resistor (printed resistor), a trimming for setting a resistance value of the control element 27 to a predetermined value is performed.

The trimming is a method for setting the resistance value of the control element 27 to the predetermined value by cutting a portion of the surface of the control element 27 that is a resistor and thereby increasing the resistance value of the control element 27. Therefore, in the state where the trimming is performed, a trimmed portion 27*a* that is a cut portion is formed on the surface of the control element 27.

In this way, the trimmed portion 27*a* is formed on the control element 27 that is a resistor. The trimmed portion 27*a* is required to be subjected to a drip-proofing process.

The frame body 32 is formed by flowable resin 44 being applied on the frame body forming part 43 of the substrate 25. For example, a silicone material is used as the flowable resin 44.

Figure 32:
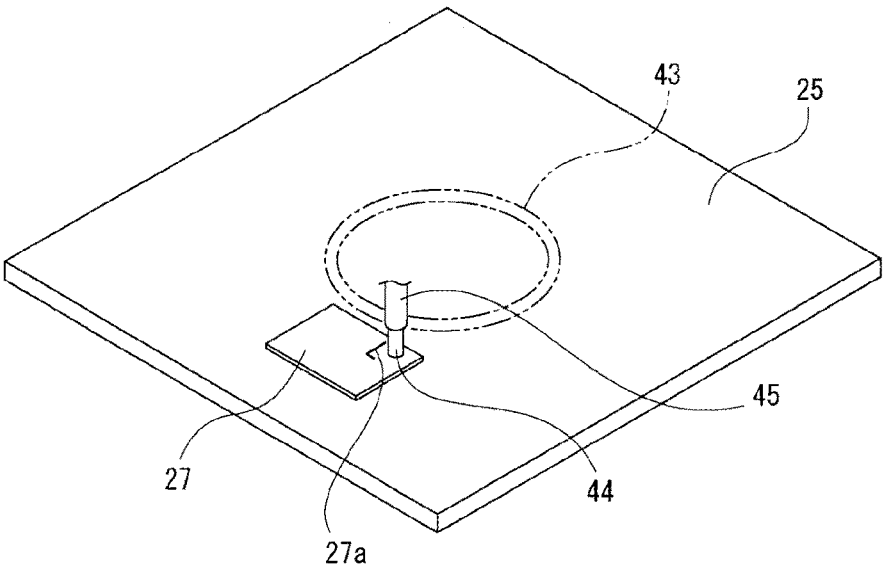
FIG. 32 is a perspective view showing a state where the discharging of the flowable resin from a nozzle is initiated.
Figure 33:
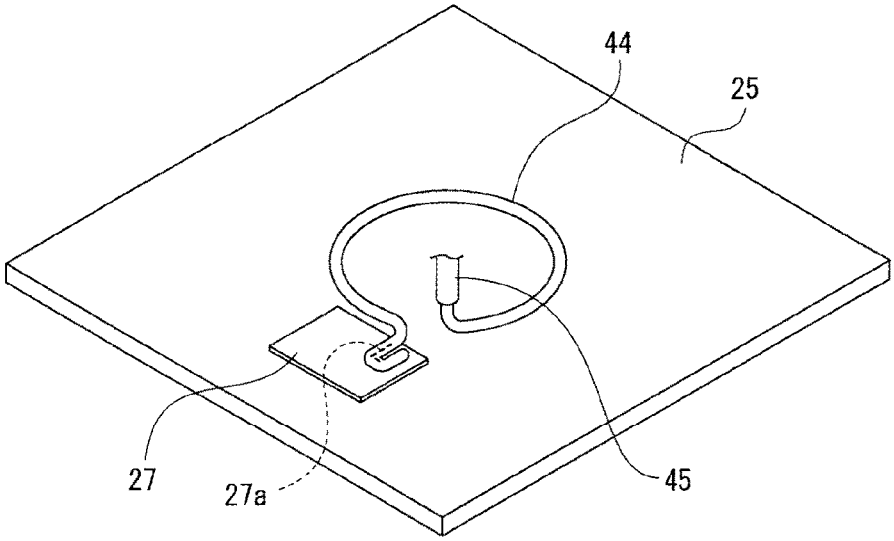
FIG. 33 is a perspective view showing a state while the frame body is formed.

The flowable resin 44 is discharged from a nozzle 45 of an application apparatus (see FIG. 32). At this time, the application of the flowable resin 44 by the nozzle 45 is initiated from above the control element 27 or its vicinity. Then, the flowable resin 44 is applied on the trimmed portion 27*a*. Subsequently, the flowable resin 44 is applied on the frame body forming part 43 (see FIG. 33).

Figure 34:
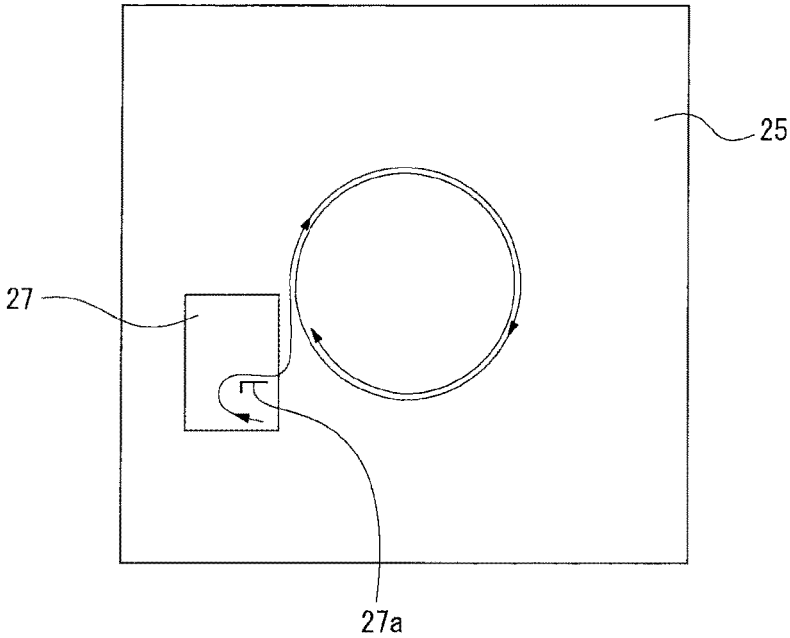
FIG. 34 is a plan view showing an application route of the flowable resin.

The application of the flowable resin 44 by the nozzle 45 is performed, for example, twice in a superposition manner on the frame body forming part 43 (see FIG. 34). That is, the application of the flowable resin 44 by the nozzle 45 is performed from an application start point S on the control element 27 or at its vicinity to the frame body forming part 43, and then, is performed to an application end point E while going round twice the frame body forming part 43.

Figure 35:
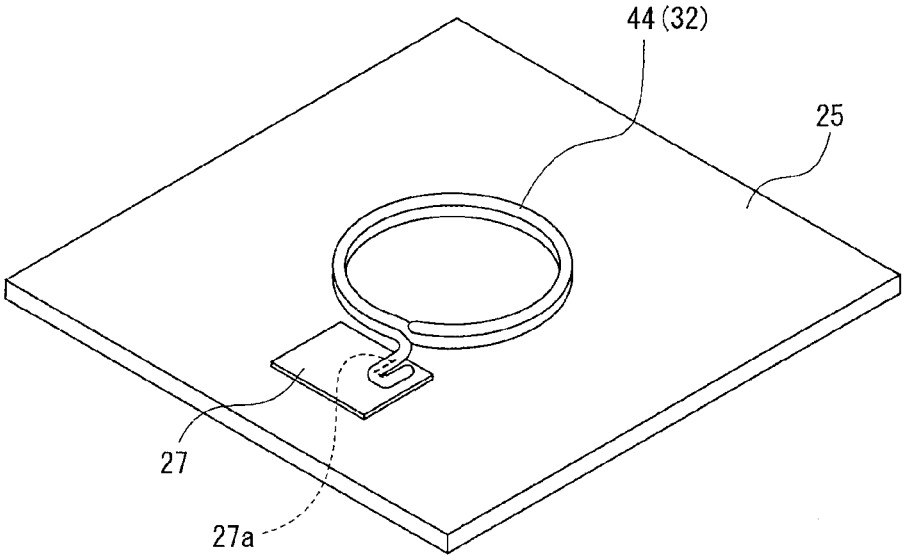
FIG. 35 is a perspective view showing a state where the frame body is formed.

Therefore, the flowable resin 44 applied on the frame body forming part 43 has a constant height by being superimposed in two stages (see FIG. 35).

When the application of the flowable resin 44 by the nozzle 45 is ended, the flowable resin 44 applied is solidified. As the flowable resin 44 applied on the frame body forming part 43 is solidified, the frame body 32 is formed. Further, as the flowable resin 44 applied on the control element 27 is solidified, the trimmed portion 27*a* is covered by the flowable resin 44 solidified. In this way, a drip-proofing for the trimmed portion 27*a* is performed.

A height of the frame body 32 is equal to or greater than that of the wire 28 connected to the light emitting element 26. When the height of the frame body 32 is equal to or greater than that of the wire 28, the sealing part 33 can be filled into the frame body 32 up to a position higher than the height of the wire 28. In this way, the light emitting element 26 disposed inside the frame body 32 and the wire 28 can be reliably sealed by the sealing part 33.

Meanwhile, in the above embodiment, an example where the frame body 32 is formed by the flowable resin 44 being applied in two stages on the frame body forming part 43 has been described. However, the number of stages of the flowable resin 44 to be superimposed may be three stages or more. Meanwhile, depending on the number of stages of the flowable resin 44 to be superimposed, the height of the frame body 32 becomes higher than necessary, and hence, there is a possibility that extraction efficiency of light emitted from the light emitting element 26 is lowered. Therefore, the number of stages of the flowable resin 44 to be superimposed is preferably set to the number of stages corresponding to a height in which the extraction efficiency of light emitted from die light emitting element 26 is not lowered.

Further, depending on the number of stages of the flowable resin 44 to be superimposed, there is a possibility that a width of the flowable resin 44 becomes greater than necessary due to its own weight. Therefore, the number of stages of the flowable resin 44 to be superimposed is preferably set to the number of stages in which a width of the frame body 32 to be formed does not become greater than necessary.

When forming the frame body 32 described above, a portion of the flowable resin 44 is applied on the control element 27 in an application process of the flowable resin 44 for forming the frame body 32, and the trimmed portion 27*a* is covered by the flowable resin 44 solidified. In this way, a drip-proofing for die trimmed portion 27*a* is performed.

Therefore, since the flowable resin 44 is applied on the control element 27 in an operation of forming the frame body 32, it is not necessary to perform a drip-proofing process on the trimmed portion 27*a*, separately from the operation of forming the frame body 32. In this way, it is possible to improve the working efficiency.

Further, since die frame body 32 is formed by the flowable resin 44 applied being solidified, an operation of attaching the frame body 32 to the substrate 25 by an adhesive is not required, unlike die case where the frame body 32 previously formed as a molded product is used. Therefore, an operation of forming the frame body 32 is easily performed and the adhesive is not required, so that it is possible to reduce the manufacturing cost.

Furthermore, since the frame body 32 is formed by a multi-stage application of the flowable resin 44, the height of the frame body 32 can be increased and the filing amount of the sealing part 33 into the frame body 32 can be increased. In this way, the light emitting element 26 and the wire 28 can be reliably sealed by the sealing part 33.

Meanwhile, in the above embodiment, an example has been described in which the application of the flowable resin 44 by the nozzle 45 is performed from die application start point S on the control element 27 or at its vicinity to the application end point E while going round twice the frame body forming part 43. However, the application start point S and the application end point E may be reversed and the application of the flowable resin 44 may be performed from a position going round twice the frame body forming part 43 to a position on the control element 27 or at its vicinity.

The invention claimed is:

1. A light source unit comprising:

a socket housing which has an engaging portion to be engaged with a predetermined member;

a light emitting module which is disposed in the socket housing and has a light emitting element serving as a light source, a substrate formed with a wiring pattern for supplying current to at least the light emitting element and a conductive part for connecting the light emitting element to the wiring pattern;

a sealing part for sealing the light emitting element and the conductive part to the substrate; and a lens part formed on the sealing part, wherein elastic modulus of the lens part is higher than that of the sealing part, and at room temperature, the elastic modulus of the sealing part is less than 1 megapascal (MPa) and the elastic modulus of the lens part is greater than or equal to 1 Mpa.

2. The light source unit according to claim 1, wherein a plurality of light emitting elements is provided, each light emitting element includes a first light emitting element and a second light emitting element, and the first light emitting element and the second light emitting element are separately sealed by the sealing part.

3. A vehicle lamp comprising the light source unit according to claim 1.

4. A light source unit comprising:

a socket housing which has an engaging portion to be engaged with a predetermined member;

a light emitting module which is disposed in the socket housing and has a light emitting element serving as a light source, a substrate formed with a wiring pattern for supplying current to at least the light emitting element and a conductive part for connecting the light emitting element to the wiring pattern;

a sealing part for sealing the light emitting element and the conductive part to the substrate; and a lens part which has a cover lens portion for covering at least a portion of the sealing part and a leg portion protruding from the cover lens portion and positioned in contact with the substrate, wherein the lens part is formed with an opening portion of the leg portion, the opening portion extending from an inner surface of the leg portion to an outer surface of the leg portion, and a part of the sealing part exists in the opening portion in a state where the sealing part is cured.

5. A vehicle lamp comprising the light source unit according to claim 4.

6. The light source unit according to claim 4, wherein the lens part is disposed on the substrate by pressing the cover lens portion against the sealing part before a curing of the sealing part.

7. The light source unit according to claim 6, wherein a boundary portion between the cover lens portion and the inner surface of the leg portion is formed as a curved surface portion.

8. The light source unit according to claim 6, wherein the cover lens portion is formed with a pressing surface which is pressed against the sealing part and is convex toward the sealing part.

9. The light source unit according claim 4, wherein a plurality of light emitting elements is provided and each light emitting element includes a first light emitting element and a second light emitting element, which are separately sealed by the sealing part.

* * * * *